United States Patent [19]

Ma et al.

[11] Patent Number: 4,902,360

[45] Date of Patent: Feb. 20, 1990

[54] PERMANENT MAGNET ALLOY FOR ELEVATED TEMPERATURE APPLICATIONS

[75] Inventors: Bao-Min Ma, Pittsburgh; Kalathur S. V. L. Narasimhan, Monroeville, both of Pa.

[73] Assignee: Crucible Materials Corporation, Pittsburgh, Pa.

[21] Appl. No.: 266,226

[22] Filed: Oct. 28, 1988

Related U.S. Application Data

[63] Continuation of Ser. No. 10,738, Feb. 4, 1987, abandoned.

[51] Int. Cl.[4] ..... H01F 1/04

[52] U.S. Cl. ..... 148/302; 420/83; 420/121

[58] Field of Search ..... 148/302; 420/83, 121

[56] References Cited

U.S. PATENT DOCUMENTS 4,533,408 8/1985 Koon ..... 148/108

FOREIGN PATENT DOCUMENTS 0101552 2/1984 European Pat. Off. ..... 148/302
0106948 5/1984 European Pat. Off. ..... 148/302
0108474 5/1984 European Pat. Off. ..... 148/302
0126179 11/1984 European Pat. Off. ..... 148/302

*Primary Examiner*—John P. Sheehan
*Attorney, Agent, or Firm*—Finnegan, Henderson, Farabow, Garrett & Dunner

[57] ABSTRACT

A permanent magnet alloy consisting essentially of $R_2Fe_{14}B$, wherein, R is a combination of rare earth elements consisting essentially of, in atomic percent, neodymium 3 to 11 and balance holmium. The alloy may include optional additions of the rare earth elements gadolinium up to 10%, terbium up to 15%, dysprosium up to 16%, erbium up to 18% and thulium up to 12%.

18 Claims, No Drawings

PERMANENT MAGNET ALLOY FOR ELEVATED TEMPERATURE APPLICATIONS

This application is a continuation of application Ser. No. 010,738 , filed February 4, 1987, abandoned.

BACKGROUND OF THE INVENTION

It is known to use permanent magnet alloys, and particularly permanent magnet alloys embodying one or more rare earth elements with a transistion element iron and boron, for applications requiring permanent magnet properties at elevated temperatures. Specifically in this regard, permanent magnets used in electric motors may encounter motor operating temperatures in excess of 150° C. The permanent magnet alloy $R_2FE_{14}B$ has a temperature dependence of magnetization of −0.08% to −0.12% per °C. over the temperature range of −50° C. to 150° C. Accordingly, this permanent magnet alloy is limited with respect to high-temperature applications, and particularly use in electric motors operating at temperatures in excess of 150° C. For practical applications, it is necessary that permanent magnet alloys at the maximum operating temperature exhibit a magnetization of 8000 Gauss.

OBJECTS OF THE INVENTION

It is accordingly an object of the present invention to provide a permanent magnet alloy of a combination of rare earth elements, the transition element iron and boron with the alloy having improved magnetization at elevated temperatures.

A more specific object of the invention is to provide a permanent magnet alloy of a composition wherein the alloy is characterized by a low temperature coefficient of magnetization, e.g., $\alpha$ less than −0.01% over °C. over a temperature range of over $\alpha$−50° C. to 250° C., with a magnetization greater than 7500 Gauss at room temperature, e.g., 23 ±2° C.

SUMMARY OF THE INVENTION

The alloy composition is a combination of rare earth elements (R), in atomic percent, in combination with the base composition $R_2Fe_{14}B$. R is neodymium 3 to 11% and balance holmium. The following are preferred limits for Nd and Ho and also preferred additional and optional rare earth elements.

| | | | | | |
|---|---|---|---|---|---|
| Nd | 4–10 | 5–11 | 7–11 | 7–11 | 7–11 |
| Ho | 83–96 | 76–94 | 78–90 | 75–95 | 82–92 |
| Tm | 0–13 | — | — | — | — |
| Er | — | 0–18 | — | — | — |
| Tb | — | — | 0–12 | — | — |
| Dy | — | — | — | 0–15 | — |
| Gd | — | — | — | — | 0–10 |
| Nd | 1–10 | 6–10 | 3–11 | 9–11 | 8–12 |
| Ho | 80–90 | 76–96 | 76–92 | 75–88 | 72–88 |
| Tb | 0–10 | — | — | 0–12 | — |
| Gd | 0–4 | — | — | — | 0–8 |
| Dy | — | 0–8 | — | 0–15 | 0–15 |
| Er | — | 0–14 | 0–18 | — | — |
| Tm | — | — | 0–12 | — | — |

The permanent magnet alloy of the invention including optional additional rare earth elements satisfies the above-stated properties with respect to a low temperature coefficient of magnetization in combination with magnetization at room temperature sufficient to enable the permanent magnets made from the alloy to retain sufficient magnetization for use at elevated temperatures.

This is achieved by combining the light rare earth element neodymium (Nd) with the heavy rare earth element holmium (Ho) with the transition element iron and boron. The heavy rare earth element provides the desired low temperature coefficient of magnetization ($\alpha$) and neodymium provides the required high magnetization ($M_s$). In this manner, as the operating temperature of the permanent magnet made from alloy is increased the base magnetization being at a relatively high level in combination with the temperature dependence or the temperature coefficient of magnetization, being low, permanent magnet properties are retained, specifically magnetization, at relatively high operating temperatures.

The permanent magnet alloy of the invention consists essentially of $R_2FE_{14}B$ wherein R is a combination of rare earth elements consisting essentially of, in atomic percent, Nd 3 to 11 and balance Ho.

The alloy may optionally contain the additional rare earth elements gadolinium (Gd) up to 10%; terbium (Tb) up to 15%; dysprosium (Dy) up to 16%; erbium (Er) up to 18%, and thulium (Tm) up to 12%. Ho is preferably within the range of 72 to 92%.

The temperature coefficient of magnetization or the temperature dependence of magnetization in alloys of neodymium and iron result from the thermal effects on the ordered magnetic moment of the Nd sublattice and the iron sublattice. The magnetic moment of the Nd sublattice decreases much more rapidly than that of the iron sublattice. This results in a strong temperature dependence of the combined magnetic moment of Nd and iron. Consequently, as is well recognized, this alloy is not suitable to provide a constant flux in the presence of temperature variations. Although with heavy rare earth elements, such as Gd, Tb, Dy, Ho, Er, Tm, and Yb, the rare earth sublattice likewise exhibits a decrease in magnetic moment with increased temperature. It has been found, however, in accordance with the resent invention, that these moments oppose the larger moment of iron sublattices to result in enhancing the net moment of the alloy in the presence of temperature increases. It has further been found with respect to these aloys in accordance with the invention, that although this net improvement in magnetic moment is observed and achieved, the magnetization of these alloys is less than required for high temperature application. It is further been found in accordance with the invention that the magnetic moment may be increased by substituting part of the heavy rare earth element content with heavy rare earth-iron-boron alloys with neodymium alone or with one or more additional heavy rare earth elements. In this manner, the required combination of high magnetization and low temperature coefficient of magnetization is achieved. It is this combination of properties that is necessary for the production of useful permanent magnets for applicatios requiring the retention of magnetization at increased temperatures during application.

DESCRIPTION OF THE PREFERRED EMBODIMENTS AND SPECIFIC EXAMPLES

The temperature dependence of magnetization ($\alpha$) of the heavy rare earth-iron-boron alloys are shown in Table I.

TABLE I

Magnetization $M_s$ and Temperature Coefficient of Heavy Rare Earth $R_2Fe_{14}B$ Alloys*

| Alloy | $M_s$ Bohr magneton/formula unit | (−50–200° C.) % per °C. |
|---|---|---|
| $Ho_2Fe_{14}B$ | 15.69 | +0.016 |
| $Tb_2Fe_{14}B$ | 13.27 | −0.007 |
| $Dy_2Fe_{14}B$ | 13.70 | +0.007 |
| $Gd_2Fe_{14}B$ | 16.56 | −0.053 |
| $Er_2FE_{14}B$ | 17.54 | −0.042 |
| $Tm_2Fe_{14}B$ | 21.80 | −0.078 |

*$\alpha = (MT2 - MT1)/M_{T1} \times (T_2 - T_1)$ in percent, $M_{T1}$ and $M_{T2}$ are the magnetizations at temperatures $T_1$ and $T_2$ respectively.

As may be seen from the data presented Table I, the alpha values for the alloys are in the desired range; however, magnetization ($M_s$) is lower than required. This is the case with respect to the alloys containing the heavy rare earth elements Ho, Tb and Dy. For the alloys of Table I having the heavy rare earth elements Gd, Er and Tm, the $M_s$ values are at acceptable levels but $\alpha$ is not within the required range.

In accordance with the invention and to demonstrate the effect of Nd with respect to increasing $M_s$, Nd was added to the heavy rare earth element containing alloys of Table I. The results from the standpoint of the combination of $M_s$ and alpha by the addition of Nd is shown by the data presented in Tables II through Tables VII.

TABLE II

Magnetization and Temperature Coefficient of $(Nd_{1-x}Tb_x)_2Fe_{14}B$ Alloys Where x = 0 to 100%

W % $Nd_2Fe_{14}B$+ X % $Tb_2Fe_{14}B$

| COMPOSITION W | X | M(25C) MB/FU | M(25C) GAUSS | ALPHA −50–200 | R SQUARE |
|---|---|---|---|---|---|
| 100 | 0 | 32.60 | 14670 | −.099 | .967 |
| 98 | 2 | 32.21 | 14496 | −.099 | .967 |
| 96 | 4 | 31.83 | 14322 | −.098 | .967 |
| 94 | 6 | 31.44 | 14148 | −.097 | .966 |
| 92 | 8 | 31.05 | 13974 | −.097 | .966 |
| 90 | 10 | 30.67 | 13800 | −.096 | .965 |
| 88 | 12 | 30.28 | 13626 | −.095 | .965 |
| 86 | 14 | 29.89 | 13452 | −.094 | .964 |
| 84 | 16 | 29.51 | 13278 | −.093 | .964 |
| 82 | 18 | 29.12 | 13104 | −.092 | .963 |
| 80 | 20 | 28.73 | 12930 | −.091 | .963 |
| 78 | 22 | 28.35 | 12756 | −.091 | .962 |
| 76 | 24 | 27.96 | 12582 | −.090 | .961 |
| 74 | 26 | 27.57 | 12408 | −.089 | .961 |
| 72 | 28 | 27.19 | 12234 | −.088 | .960 |
| 70 | 30 | 26.80 | 12060 | −.087 | .959 |
| 68 | 32 | 26.41 | 11886 | −.085 | .958 |
| 66 | 34 | 26.03 | 11713 | −.084 | .957 |
| 64 | 36 | 25.64 | 11539 | −.083 | .956 |
| 62 | 38 | 25.25 | 11365 | −.082 | .955 |
| 60 | 40 | 24.87 | 11191 | −.081 | .954 |
| 58 | 42 | 24.48 | 11017 | −.080 | .953 |
| 56 | 44 | 24.09 | 10843 | −.078 | .952 |
| 54 | 46 | 23.71 | 10669 | −.077 | .950 |
| 52 | 48 | 23.32 | 10495 | −.075 | .949 |
| 50 | 50 | 22.94 | 10321 | −.074 | .947 |
| 48 | 52 | 22.55 | 10147 | −.073 | .945 |
| 46 | 54 | 22.16 | 9973 | −.071 | .943 |
| 44 | 56 | 21.78 | 9799 | −.069 | .941 |
| 42 | 58 | 21.39 | 9625 | −.068 | .939 |
| 40 | 60 | 21.00 | 9451 | −.066 | .936 |
| 38 | 62 | 20.62 | 9277 | −.064 | .933 |
| 36 | 64 | 20.23 | 9103 | −.062 | .929 |
| 34 | 66 | 19.84 | 8929 | −.060 | .926 |
| 32 | 68 | 19.46 | 8755 | −.058 | .921 |
| 30 | 70 | 19.07 | 8581 | −.056 | .916 |
| 28 | 72 | 18.68 | 8407 | −.054 | .910 |
| 26 | 74 | 18.30 | 8233 | −.051 | .903 |
| 24 | 76 | 17.91 | 8059 | −.049 | .895 |

TABLE II-continued

Magnetization and Temperature Coefficient of $(Nd_{1-x}Tb_x)_2Fe_{14}B$ Alloys Where x = 0 to 100%

W % $Nd_2Fe_{14}B$+ X % $Tb_2Fe_{14}B$

| COMPOSITION W | X | M(25C) MB/FU | M(25C) GAUSS | ALPHA −50–200 | R SQUARE |
|---|---|---|---|---|---|
| 22 | 78 | 17.52 | 7885 | −.046 | .885 |
| 20 | 80 | 17.14 | 7711 | −.044 | .873 |
| 18 | 82 | 16.75 | 7537 | −.041 | .858 |
| 16 | 84 | 16.36 | 7363 | −.038 | .839 |
| 14 | 86 | 15.98 | 7189 | −.035 | .816 |
| 12 | 88 | 15.59 | 7015 | −.032 | .785 |
| 10 | 90 | 15.20 | 6841 | −.028 | .744 |
| 8 | 92 | 14.82 | 6667 | −.024 | .689 |
| 6 | 94 | 14.43 | 6493 | −.020 | .611 |
| 4 | 96 | 14.04 | 6319 | −.016 | .501 |
| 2 | 98 | 13.66 | 6145 | −.012 | .351 |
| 0 | 100 | 13.27 | 5972 | −.007 | .167 |

TABLE III

Magnetization and Temperature Coefficient of $(Nd_{1-x}Gd_x)_2Fe_{14}B$ Alloys Where x = 0 to 100%

W % $Nd_2Fe_{14}B$+ X % $Gd_2Fe_{14}B$

| COMPOSITION W | X | M(25C) MB/FU | M(25C) GAUSS | ALPHA −50–200 | R SQUARE |
|---|---|---|---|---|---|
| 100 | 0 | 32.60 | 14670 | −.099 | .967 |
| 98 | 2 | 32.28 | 14526 | −.099 | .967 |
| 96 | 4 | 31.96 | 14381 | −.099 | .966 |
| 94 | 6 | 31.64 | 14237 | −.098 | .966 |
| 92 | 8 | 31.32 | 14093 | −.098 | .965 |
| 90 | 10 | 31.00 | 13498 | −.097 | .965 |
| 88 | 12 | 30.68 | 13626 | −.097 | .965 |
| 86 | 14 | 30.35 | 13452 | −.096 | .964 |
| 84 | 16 | 30.03 | 13515 | −.096 | .964 |
| 82 | 18 | 29.71 | 13371 | −.095 | .963 |
| 80 | 20 | 29.39 | 13227 | −.094 | .963 |
| 78 | 22 | 29.07 | 13082 | −.094 | .962 |
| 76 | 24 | 28.75 | 12938 | −.093 | .961 |
| 74 | 26 | 28.43 | 12794 | −.093 | .961 |
| 72 | 28 | 28.11 | 12649 | −.092 | .960 |
| 70 | 30 | 27.79 | 12505 | −.091 | .959 |
| 68 | 32 | 27.47 | 12361 | −.091 | .958 |
| 66 | 34 | 27.15 | 12216 | −.090 | .958 |
| 64 | 36 | 26.83 | 12072 | −.089 | .957 |
| 62 | 38 | 26.51 | 11928 | −.089 | .956 |
| 60 | 40 | 26.19 | 11784 | −.088 | .955 |
| 58 | 42 | 25.86 | 11639 | −.087 | .954 |
| 56 | 44 | 25.54 | 11495 | −.087 | .953 |
| 54 | 46 | 25.22 | 11351 | −.086 | .952 |
| 52 | 48 | 24.90 | 11206 | −.085 | .951 |
| 50 | 50 | 24.58 | 11062 | −.084 | .949 |
| 48 | 52 | 24.26 | 10918 | −.083 | .948 |
| 46 | 54 | 23.94 | 10773 | −.083 | .947 |
| 44 | 56 | 23.62 | 10629 | −.082 | .945 |
| 42 | 58 | 23.30 | 10485 | −.081 | .944 |
| 40 | 60 | 22.98 | 10340 | −.080 | .942 |
| 38 | 62 | 22.66 | 10196 | −.079 | .940 |
| 36 | 64 | 22.34 | 10052 | −.078 | .938 |
| 34 | 66 | 22.02 | 9907 | −.077 | .936 |
| 32 | 68 | 21.70 | 9763 | −.076 | .934 |
| 30 | 70 | 21.37 | 9619 | −.075 | .931 |
| 28 | 72 | 21.05 | 9474 | −.074 | .928 |
| 26 | 74 | 20.73 | 9330 | −.072 | .926 |
| 24 | 76 | 20.41 | 9186 | −.071 | .922 |
| 22 | 78 | 20.09 | 9041 | −.070 | .919 |
| 20 | 80 | 19.77 | 8897 | −.069 | .915 |
| 18 | 82 | 19.45 | 8753 | −.068 | .911 |
| 16 | 84 | 19.13 | 8608 | −.066 | .907 |
| 14 | 86 | 18.81 | 8464 | −.065 | .902 |
| 12 | 88 | 18.49 | 8320 | −.063 | .896 |
| 10 | 90 | 18.17 | 8175 | −.063 | .890 |
| 8 | 92 | 17.85 | 8031 | −.060 | .883 |
| 6 | 94 | 17.53 | 7887 | −.059 | .875 |
| 4 | 96 | 17.21 | 7742 | −.057 | .867 |
| 2 | 98 | 16.88 | 7598 | −.055 | .857 |

TABLE III-continued

Magnetization and Temperature Coefficient of $(Nd_{1-x}Gd_x)_2Fe_{14}B$ Alloys Where x = 0 to 100%
W % $Nd_2Fe_{14}B$+ X % $Gd_2Fe_{14}B$

| COMPOSITION W | X | M(25C) MB/FU | M(25C) GAUSS | ALPHA −50-200 | R SQUARE |
|---|---|---|---|---|---|
| 0 | 100 | 16.56 | 7454 | −.053 | .846 |

TABLE IV

Magnetization and Temperature Coefficient of $(Nd_{1-x}Dy_x)_2Fe_{14}B$ Alloys Where x = 0 to 100%
W % $Nd_2Fe_{14}B$+ X % $Dy_2Fe_{14}B$

| COMPOSITION W | X | M(25C) MB/FU | M(25C) GAUSS | ALPHA −50-200 | R SQUARE |
|---|---|---|---|---|---|
| 100 | 0 | 32.60 | 14670 | −.099 | .967 |
| 98 | 2 | 32.21 | 14496 | −.099 | .966 |
| 96 | 4 | 31.83 | 14322 | −.098 | .966 |
| 94 | 6 | 31.44 | 14148 | −.097 | .965 |
| 92 | 8 | 31.05 | 13974 | −.096 | .964 |
| 90 | 10 | 30.67 | 13800 | −.095 | .963 |
| 88 | 12 | 30.28 | 13626 | −.094 | .962 |
| 86 | 14 | 29.89 | 13452 | −.093 | .961 |
| 84 | 16 | 29.51 | 13278 | −.092 | .960 |
| 82 | 18 | 29.12 | 13104 | −.091 | .958 |
| 80 | 20 | 28.73 | 12930 | −.090 | .957 |
| 78 | 22 | 28.35 | 12756 | −.089 | .956 |
| 76 | 24 | 27.96 | 12582 | −.087 | .954 |
| 74 | 26 | 27.57 | 12408 | −.086 | .953 |
| 72 | 28 | 27.19 | 12234 | −.085 | .951 |
| 70 | 30 | 26.80 | 12060 | −.084 | .949 |
| 68 | 32 | 26.41 | 11886 | −.082 | .947 |
| 66 | 34 | 26.03 | 11713 | −.081 | .945 |
| 64 | 36 | 25.64 | 11539 | −.080 | .942 |
| 62 | 38 | 25.25 | 11365 | −.078 | .940 |
| 60 | 40 | 24.87 | 11191 | −.077 | .937 |
| 58 | 42 | 24.48 | 11017 | −.075 | .934 |
| 56 | 44 | 24.09 | 10843 | −.073 | .930 |
| 54 | 46 | 23.71 | 10669 | −.072 | .926 |
| 52 | 48 | 23.32 | 10495 | −.070 | .922 |
| 50 | 50 | 22.94 | 10321 | −.068 | .917 |
| 48 | 52 | 22.55 | 10147 | −.066 | .912 |
| 46 | 54 | 22.16 | 9973 | −.064 | .906 |
| 44 | 56 | 21.78 | 9799 | −.062 | .899 |
| 42 | 58 | 21.39 | 9625 | −.060 | .892 |
| 40 | 60 | 21.00 | 9421 | −.058 | .883 |
| 38 | 62 | 20.62 | 9277 | −.056 | .873 |
| 36 | 64 | 20.23 | 9103 | −.054 | .861 |
| 34 | 66 | 19.84 | 8929 | −.051 | .847 |
| 32 | 68 | 19.46 | 8755 | −.049 | .831 |
| 30 | 70 | 19.07 | 8581 | −.046 | .812 |
| 28 | 72 | 18.68 | 8407 | −.043 | .789 |
| 26 | 74 | 18.30 | 8233 | −.040 | .761 |
| 24 | 76 | 17.91 | 8059 | −.037 | .728 |
| 22 | 78 | 17.52 | 7885 | −.034 | .686 |
| 20 | 80 | 17.14 | 7711 | −.031 | .634 |
| 18 | 82 | 16.75 | 7537 | −.027 | .570 |
| 16 | 84 | 16.36 | 7363 | −.023 | .491 |
| 14 | 86 | 15.98 | 7189 | −.020 | .395 |
| 12 | 88 | 15.59 | 7015 | −.015 | .283 |
| 10 | 90 | 15.20 | 6841 | −.011 | .164 |
| 8 | 92 | 14.82 | 6667 | −.006 | .060 |
| 6 | 94 | 14.43 | 6493 | −.001 | .003 |
| 4 | 96 | 14.04 | 6319 | −.004 | .021 |
| 2 | 98 | 13.66 | 6145 | −.009 | .110 |
| 0 | 100 | 13.27 | 5972 | −.015 | .243 |

TABLE V

Magnetization and Temperature Coefficient of $(Nd_{1-x}Tm_x)_2Fe_{14}B$ Alloys Where x = 0 to 100%
W % $Nd_2Fe_{14}B$+ X % $Tm_2Fe_{14}B$

| COMPOSITION W | X | M(25C) MB/FU | M(25C) GAUSS | ALPHA −50-200 | R SQUARE |
|---|---|---|---|---|---|
| 100 | 0 | 32.60 | 14670 | −.099 | .967 |
| 98 | 2 | 32.38 | 14573 | −.099 | .965 |
| 96 | 4 | 32.17 | 14476 | −.099 | .963 |
| 94 | 6 | 31.95 | 14378 | −.099 | .961 |
| 92 | 8 | 31.74 | 14281 | −.098 | .958 |
| 90 | 10 | 31.52 | 14184 | −.098 | .955 |
| 88 | 12 | 31.30 | 14087 | −.098 | .952 |
| 86 | 14 | 31.09 | 13990 | −.097 | .949 |
| 84 | 16 | 30.87 | 13892 | −.097 | .946 |
| 82 | 18 | 30.66 | 13795 | −.097 | .943 |
| 80 | 20 | 30.44 | 13698 | −.096 | .940 |
| 78 | 22 | 30.22 | 13601 | −.096 | .936 |
| 76 | 24 | 30.01 | 13504 | −.096 | .932 |
| 74 | 26 | 29.79 | 13407 | −.095 | .928 |
| 72 | 28 | 29.58 | 13309 | −.095 | .924 |
| 70 | 30 | 29.36 | 13212 | −.095 | .919 |
| 68 | 32 | 29.14 | 13115 | −.094 | .914 |
| 66 | 34 | 28.93 | 13018 | −.094 | .910 |
| 64 | 36 | 28.71 | 12921 | −.094 | .904 |
| 62 | 38 | 28.50 | 12823 | −.093 | .899 |
| 60 | 40 | 28.28 | 12726 | −.093 | .893 |
| 58 | 42 | 28.06 | 12629 | −.093 | .887 |
| 56 | 44 | 27.85 | 12535 | −.092 | .881 |
| 54 | 46 | 27.63 | 12435 | −.092 | .875 |
| 52 | 48 | 27.42 | 12337 | −.091 | .868 |
| 50 | 50 | 27.20 | 12240 | −.091 | .861 |
| 48 | 52 | 26.98 | 12143 | −.091 | .854 |
| 46 | 54 | 26.77 | 12046 | −.090 | .847 |
| 44 | 56 | 26.55 | 11949 | −.090 | .839 |
| 42 | 58 | 26.34 | 11851 | −.089 | .831 |
| 40 | 60 | 26.12 | 11754 | −.089 | .822 |
| 38 | 62 | 25.90 | 11657 | −.088 | .813 |
| 36 | 64 | 25.69 | 11650 | −.088 | .804 |
| 34 | 66 | 25.47 | 11463 | −.088 | .795 |
| 32 | 68 | 25.26 | 11366 | −.087 | .785 |
| 30 | 70 | 25.04 | 11268 | −.087 | .775 |
| 28 | 72 | 24.82 | 11171 | −.086 | .765 |
| 26 | 74 | 24.61 | 11074 | −.086 | .754 |
| 24 | 76 | 24.39 | 10977 | −.085 | .743 |
| 22 | 78 | 24.18 | 10880 | −.085 | .732 |
| 20 | 80 | 23.96 | 10782 | −.084 | .720 |
| 18 | 82 | 23.74 | 10685 | −.084 | .708 |
| 16 | 84 | 23.53 | 10588 | −.083 | .695 |
| 14 | 86 | 23.31 | 10491 | −.082 | .683 |
| 12 | 88 | 23.10 | 10394 | −.082 | .670 |
| 10 | 90 | 22.88 | 10296 | −.081 | .656 |
| 8 | 92 | 22.66 | 10199 | −.081 | .643 |
| 6 | 94 | 22.45 | 10102 | −.080 | .629 |
| 4 | 96 | 22.23 | 10005 | −.080 | .614 |
| 2 | 98 | 22.02 | 9908 | −.079 | .600 |
| 0 | 100 | 21.80 | 9810 | −.078 | .585 |

TABLE VI

Magnetization and Temperature Coefficient of $(Nd_{1-x}Er_x)$ $Fe_{14}B$ Alloys Where x = 0 to 100%
W % $Nd_2Fe_{14}B$+ X % $Er_2Fe_{14}B$

| COMPOSITION W | X | M(25C) MB/FU | M(25C) GAUSS | ALPHA −50-200 | R SQUARE |
|---|---|---|---|---|---|
| 100 | 0 | 32.60 | 14670 | −.099 | .967 |
| 98 | 2 | 32.30 | 14534 | −.099 | .965 |
| 96 | 4 | 32.00 | 14399 | −.098 | .963 |
| 94 | 6 | 31.70 | 14263 | −.098 | .961 |
| 92 | 8 | 31.39 | 14128 | −.097 | .958 |
| 90 | 10 | 31.09 | 13992 | −.096 | .956 |
| 88 | 12 | 30.79 | 13857 | −.096 | .953 |
| 86 | 14 | 30.49 | 13721 | −.095 | .950 |
| 84 | 16 | 30.19 | 13585 | −.094 | .947 |
| 82 | 18 | 29.89 | 13450 | −.094 | .943 |
| 80 | 20 | 29.59 | 13314 | −.093 | .940 |

TABLE VI-continued

Magnetization and Temperature Coefficient of $(Nd_{1-x}Er_x)$ $Fe_{14}B$ Alloys Where x = 0 to 100%

W % $Nd_2Fe_{14}B$+ X % $Er_2Fe_{14}B$

| COMPOSITION W | X | M(25C) MB/FU | M(25C) GAUSS | ALPHA −50−200 | R SQUARE |
|---|---|---|---|---|---|
| 78 | 22 | 29.29 | 13179 | −.092 | .936 |
| 76 | 24 | 28.98 | 13043 | −.091 | .932 |
| 74 | 26 | 28.68 | 12908 | −.091 | .927 |
| 72 | 28 | 28.38 | 12772 | −.090 | .923 |
| 70 | 30 | 28.08 | 12636 | −.089 | .918 |
| 68 | 32 | 27.78 | 12501 | −.088 | .912 |
| 66 | 34 | 27.48 | 12365 | −.087 | .906 |
| 64 | 36 | 27.18 | 12230 | −.087 | .900 |
| 62 | 38 | 26.88 | 12094 | −.086 | .893 |
| 60 | 40 | 26.57 | 11958 | −.085 | .886 |
| 58 | 42 | 26.27 | 11823 | −.084 | .879 |
| 56 | 44 | 25.97 | 11867 | −.083 | .871 |
| 54 | 46 | 25.67 | 11552 | −.082 | .862 |
| 52 | 48 | 25.37 | 11416 | −.081 | .853 |
| 50 | 50 | 25.07 | 11281 | −.080 | .843 |
| 48 | 52 | 24.77 | 11145 | −.079 | .832 |
| 46 | 54 | 24.47 | 11009 | −.078 | .821 |
| 44 | 56 | 24.16 | 10874 | −.077 | .809 |
| 42 | 58 | 23.86 | 10738 | −.076 | .796 |
| 40 | 60 | 23.56 | 10603 | −.075 | .782 |
| 38 | 62 | 23.26 | 10467 | −.073 | .767 |
| 36 | 64 | 22.96 | 10332 | −.072 | .751 |
| 34 | 66 | 22.66 | 10196 | −.071 | .735 |
| 32 | 68 | 22.36 | 10060 | −.070 | .717 |
| 30 | 70 | 22.06 | 9925 | −.068 | .698 |
| 28 | 72 | 21.75 | 9789 | −.067 | .678 |
| 26 | 74 | 21.45 | 9654 | −.066 | .656 |
| 24 | 76 | 21.15 | 9518 | −.064 | .634 |
| 22 | 78 | 20.85 | 9383 | −.063 | .610 |
| 20 | 80 | 20.55 | 9247 | −.061 | .585 |
| 18 | 82 | 20.25 | 9111 | −.059 | .559 |
| 16 | 84 | 19.95 | 8976 | −.058 | .531 |
| 14 | 86 | 19.64 | 8840 | −.056 | .502 |
| 12 | 88 | 19.34 | 8705 | −.054 | .473 |
| 10 | 90 | 19.04 | 8569 | −.053 | .442 |
| 8 | 92 | 18.74 | 8434 | −.051 | .410 |
| 6 | 94 | 18.44 | 8298 | −.049 | .378 |
| 4 | 96 | 18.14 | 8162 | −.047 | .345 |
| 2 | 98 | 17.84 | 8027 | −.045 | .312 |
| 0 | 100 | 17.54 | 7891 | −.042 | .280 |

TABLE VII

Magnetization and Temperature Coefficient of $(Nd_{1-x}Ho_x)_2$ $Fe_{14}B$ Alloys Where x = 0 to 100%

W % $Nd_2Fe_{14}B$+ X % $Ho_2FE_{14}B$

| COMPOSITION W | X | M(25C) MB/FU | M(25C) GAUSS | ALPHA −50−200 | R SQUARE |
|---|---|---|---|---|---|
| 100 | 0 | 32.60 | 14670 | −.099 | .967 |
| 98 | 2 | 32.26 | 14518 | −.098 | .966 |
| 96 | 4 | 31.92 | 14366 | −.097 | .965 |
| 94 | 6 | 31.59 | 14213 | −.096 | .963 |
| 92 | 8 | 31.25 | 14061 | −.095 | .962 |
| 90 | 10 | 30.91 | 13909 | −.094 | .960 |
| 88 | 12 | 30.57 | 13757 | −.093 | .959 |
| 86 | 14 | 30.23 | 13604 | −.092 | .957 |
| 84 | 16 | 29.89 | 13452 | −.091 | .955 |
| 82 | 18 | 29.56 | 13300 | −.089 | .953 |
| 80 | 20 | 29.22 | 13148 | −.088 | .951 |
| 78 | 22 | 28.88 | 12996 | −.087 | .948 |
| 76 | 24 | 28.54 | 12843 | −.085 | .946 |
| 74 | 26 | 28.20 | 12691 | −.084 | .943 |
| 72 | 28 | 27.86 | 12539 | −.083 | .940 |
| 70 | 30 | 27.53 | 12387 | −.081 | .936 |
| 68 | 32 | 27.19 | 12235 | −.080 | .933 |
| 66 | 34 | 26.85 | 12082 | −.078 | .929 |
| 64 | 36 | 26.51 | 11930 | −.077 | .924 |
| 62 | 38 | 26.17 | 11778 | −.075 | .920 |
| 60 | 40 | 25.83 | 11626 | −.073 | .914 |
| 58 | 42 | 25.50 | 11473 | −.072 | .909 |
| 56 | 44 | 25.16 | 11321 | −.070 | .902 |

TABLE VII-continued

Magnetization and Temperature Coefficient of $(Nd_{1-x}Ho_x)_2$ $Fe_{14}B$ Alloys Where x = 0 to 100%

W % $Nd_2Fe_{14}B$+ X % $Ho_2FE_{14}B$

| COMPOSITION W | X | M(25C) MB/FU | M(25C) GAUSS | ALPHA −50−200 | R SQUARE |
|---|---|---|---|---|---|
| 54 | 46 | 24.82 | 11169 | −.068 | .895 |
| 52 | 48 | 24.48 | 11017 | −.066 | .887 |
| 50 | 50 | 24.14 | 10865 | −.064 | .878 |
| 48 | 52 | 23.81 | 10712 | −.062 | .868 |
| 46 | 54 | 23.47 | 10560 | −.060 | .857 |
| 44 | 56 | 23.13 | 10408 | −.058 | .844 |
| 42 | 58 | 22.79 | 10256 | −.056 | .830 |
| 40 | 60 | 22.45 | 10103 | −.054 | .814 |
| 38 | 62 | 22.11 | 9951 | −.051 | .795 |
| 36 | 64 | 21.78 | 9799 | −.049 | .773 |
| 34 | 66 | 21.44 | 9647 | −.047 | .748 |
| 32 | 68 | 21.10 | 9495 | −.044 | .720 |
| 30 | 70 | 20.76 | 9342 | −.041 | .686 |
| 28 | 72 | 20.42 | 9190 | −.038 | .648 |
| 26 | 74 | 20.08 | 9038 | −.036 | .603 |
| 24 | 76 | 19.75 | 8886 | −.033 | .551 |
| 22 | 78 | 19.41 | 8734 | −.029 | .491 |
| 20 | 80 | 19.07 | 8581 | −.026 | .424 |
| 18 | 82 | 18.73 | 8429 | −.023 | .349 |
| 16 | 84 | 18.39 | 8277 | −.019 | .269 |
| 14 | 86 | 18.05 | 8125 | −.016 | .187 |
| 12 | 88 | 17.72 | 7972 | −.012 | .111 |
| 10 | 90 | 17.38 | 7820 | −.008 | .049 |
| 8 | 92 | 17.04 | 7668 | −.003 | .010 |
| 6 | 94 | 16.70 | 7516 | .001 | .001 |
| 4 | 96 | 16.36 | 7364 | .006 | .024 |
| 2 | 98 | 16.03 | 7211 | .011 | .075 |
| 0 | 100 | 15.69 | 7059 | .016 | .146 |

In Tables II through Tables VII it may be seen that complete replacement of the heavy rare earth element with Nd is not desirable as the resulting values are not within the required range. In addition, the values ar not improved by the addition of Nd except for the relatively narrow ranges of Nd in combination with Ho in accordance with the composition limits of the invention.

It was additionally determined from an analysis of the magnitization curve as a function of temperature that a combination of two or more heavy rare earth elements with neodynium-iron-boron may provide optimum properties in accordance with the invention.

TABLE VIII

Magnetization and Temperature Coefficient of $(NdDyHo)_2$ $Fe_{14}B$ Alloys

W % $Dy_2F_{14}B$+ X % $Nd_2Fe_{14}B$+ Y % $Ho_2FE_{14}B$

| COMPOSITION W | X | Y | M(25C) MB/FU | M(25C) GAUSS | ALPHA −50−200 | R SQUARE |
|---|---|---|---|---|---|---|
| 96 | 4 | 0 | 14.04 | 6319 | .004 | .021 |
| 86 | 4 | 10 | 14.28 | 6428 | .004 | .021 |
| 76 | 4 | 20 | 14.53 | 6537 | .004 | .022 |
| 66 | 4 | 30 | 14.77 | 6646 | .004 | .022 |
| 56 | 4 | 40 | 15.01 | 6755 | .005 | .022 |
| 46 | 4 | 50 | 15.25 | 6863 | .005 | .023 |
| 36 | 4 | 60 | 15.49 | 6972 | .005 | .023 |
| 26 | 4 | 70 | 15.74 | 7081 | .005 | .023 |
| 16 | 4 | 80 | 15.98 | 7190 | .005 | .024 |
| 6 | 4 | 90 | 16.22 | 7298 | .006 | .024 |
| 94 | 6 | 0 | 14.43 | 6493 | −.001 | .003 |
| 84 | 6 | 10 | 14.67 | 6602 | −.001 | .002 |
| 74 | 6 | 20 | 14.91 | 6711 | −.001 | .001 |
| 64 | 6 | 30 | 15.15 | 6820 | −.001 | .000 |
| 54 | 6 | 40 | 15.40 | 6928 | −.000 | .000 |
| 44 | 6 | 50 | 15.64 | 7037 | −.000 | .000 |
| 34 | 6 | 60 | 15.88 | 7146 | .000 | .000 |
| 24 | 6 | 70 | 16.12 | 7255 | .000 | .000 |
| 14 | 6 | 80 | 16.36 | 7364 | .001 | .000 |
| 4 | 6 | 90 | 16.61 | 7472 | .001 | .001 |
| 92 | 8 | 0 | 14.82 | 6667 | −.006 | .060 |
| 82 | 8 | 10 | 15.06 | 6776 | −.006 | .050 |

TABLE VIII-continued

Magnetization and Temperature Coefficient of $(NdDyHo)_2 Fe_{14}B$ Alloys
W % $Dy_2F_{14}B$+ X % $Nd_2Fe_{14}B$+ Y % $Ho_2FE_{14}B$

| COMPOSITION | | | M(25C) | M(25C) | ALPHA | |
|---|---|---|---|---|---|---|
| W | X | Y | MB/FU | GAUSS | −50−200 | R SQUARE |
| 72 | 8 | 20 | 15.30 | 6885 | −.006 | .041 |
| 62 | 8 | 30 | 15.54 | 6994 | −.005 | .034 |
| 52 | 8 | 40 | 15.78 | 7102 | −.005 | .028 |
| 42 | 8 | 50 | 16.02 | 7211 | −.005 | .023 |
| 32 | 8 | 60 | 16.27 | 7320 | −.004 | .019 |
| 22 | 8 | 70 | 16.51 | 7429 | −.004 | .015 |
| 12 | 8 | 80 | 16.75 | 7538 | −.004 | .013 |
| 2 | 8 | 90 | 16.99 | 7646 | −.003 | .010 |
| 90 | 10 | 0 | 15.20 | 6841 | −.011 | .164 |
| 80 | 10 | 10 | 15.44 | 6950 | −.011 | .143 |
| 70 | 10 | 20 | 15.69 | 7069 | −.010 | .125 |
| 60 | 10 | 30 | 15.93 | 7168 | −.010 | .109 |
| 50 | 10 | 40 | 16.17 | 7275 | −.009 | .095 |
| 40 | 10 | 50 | 16.41 | 7385 | −.009 | .083 |
| 30 | 10 | 60 | 16.65 | 7494 | −.009 | .073 |
| 20 | 10 | 70 | 17.14 | 7603 | −.008 | .064 |
| 10 | 10 | 80 | 17/14 | 7711 | −.008 | .056 |
| 0 | 10 | 90 | 17.38 | 7820 | −.008 | .049 |
| 88 | 12 | 0 | 15.59 | 7014 | −.015 | .283 |
| 78 | 12 | 10 | 15.83 | 7124 | −.015 | .254 |
| 68 | 12 | 20 | 16.07 | 7233 | −.014 | .228 |
| 58 | 12 | 30 | 16.31 | 7342 | −.014 | .205 |
| 48 | 12 | 30 | 16.56 | 7450 | −.014 | .184 |
| 38 | 12 | 50 | 16.80 | 7559 | −.013 | .166 |
| 28 | 12 | 60 | 17.04 | 7668 | −.013 | .149 |
| 18 | 12 | 70 | 17.28 | 7777 | −.012 | .134 |
| 8 | 12 | 80 | 17.52 | 7885 | −.012 | .121 |
| 86 | 14 | 0 | 15.98 | 7189 | −.020 | .395 |
| 76 | 14 | 10 | 16.22 | 7298 | −.019 | .363 |
| 66 | 14 | 20 | 16.46 | 7407 | −.019 | .333 |
| 56 | 14 | 30 | 16.70 | 7516 | −.018 | .305 |
| 46 | 14 | 40 | 16.94 | 7624 | −.018 | .280 |
| 36 | 14 | 50 | 17.18 | 7733 | −.017 | .256 |
| 26 | 14 | 60 | 17.43 | 7842 | −.017 | .235 |
| 16 | 14 | 70 | 17.67 | 7951 | −.016 | .215 |
| 6 | 14 | 80 | 17.91 | 8059 | −.016 | .197 |
| 84 | 16 | 0 | 16.36 | 7363 | −.023 | .491 |
| 74 | 16 | 10 | 16.60 | 7472 | −.023 | .459 |
| 64 | 16 | 20 | 16.85 | 7581 | −.022 | .428 |
| 54 | 16 | 30 | 17.09 | 7690 | −.022 | .399 |
| 44 | 16 | 40 | 17.33 | 7798 | −.021 | .371 |
| 34 | 16 | 50 | 17.57 | 7907 | −.021 | .345 |
| 24 | 16 | 60 | 17.81 | 8016 | −.020 | .321 |
| 14 | 16 | 70 | 18.05 | 8125 | −.020 | .298 |
| 4 | 16 | 80 | 18.30 | 8233 | −.019 | .277 |
| 82 | 18 | 0 | 16.75 | 7537 | −.027 | .570 |
| 72 | 18 | 10 | 16.99 | 7646 | −.027 | .539 |
| 62 | 18 | 20 | 17.23 | 7755 | −.026 | .509 |
| 52 | 18 | 30 | 17.47 | 7864 | −.025 | .480 |
| 42 | 18 | 40 | 17.72 | 7972 | −.025 | .453 |
| 32 | 18 | 50 | 17.96 | 8081 | −.024 | .426 |
| 22 | 18 | 60 | 18.20 | 8190 | −.024 | .401 |
| 12 | 18 | 70 | 18.44 | 8299 | −.023 | .376 |
| 2 | 18 | 80 | 18.68 | 8407 | −.023 | .354 |
| 80 | 20 | 0 | 17.14 | 7711 | −.031 | .634 |
| 70 | 20 | 10 | 17.38 | 7820 | −.030 | .606 |
| 60 | 20 | 20 | 17.62 | 7929 | −.029 | .578 |
| 50 | 20 | 30 | 17.86 | 8146 | −.029 | .550 |
| 40 | 20 | 40 | 18.10 | 8146 | −.028 | .523 |
| 30 | 20 | 50 | 18.34 | 8255 | −.028 | .497 |
| 20 | 20 | 60 | 18.59 | 8364 | −.027 | .472 |
| 10 | 20 | 70 | 18.83 | 8473 | −.027 | .447 |
| 0 | 20 | 80 | 19.07 | 8581 | −.026 | .424 |

As shown from Table VIII, by adding Nd to a combination of Ho and Dy in an iron-boron alloy both the alpha and $M_s$ are achieved in combination only when Nd is within the range of 8 to 11%, Ho in the range of 75 to 92%, and Dy in the range of 0 to 15%.

TABLE IX

Magnetization and Temperature Coefficient of (NdDyTm) Alloys
W % $Dy_2Fe_{14}B$+ X % $Nd_2Fe_{14}B$+ Y % $Tm_2Fe_{14}B$

| COMPOSITION | | | M(25C) | M(25C) | ALPHA | |
|---|---|---|---|---|---|---|
| W | X | Y | MB/FU | GAUSS | −50−200 | R SQUARE |
| 96 | 4 | 0 | 14.04 | 6319 | .004 | .021 |
| 86 | 4 | 10 | 14.90 | 6703 | −.010 | .089 |
| 76 | 4 | 20 | 15.75 | 7087 | −.022 | .259 |
| 66 | 4 | 30 | 16.60 | 7471 | −.033 | .377 |
| 56 | 4 | 40 | 17.46 | 7855 | −.042 | .454 |
| 46 | 4 | 50 | 18.31 | 8239 | −.050 | .505 |
| 36 | 4 | 60 | 19.16 | 8623 | −.058 | .542 |
| 26 | 4 | 70 | 20.01 | 9007 | −.065 | .569 |
| 16 | 4 | 80 | 20.87 | 9391 | −.071 | .590 |
| 6 | 4 | 90 | 21.72 | 9774 | −.076 | .606 |
| 94 | 6 | 0 | 14.43 | 6493 | −.001 | .003 |
| 84 | 6 | 10 | 15.28 | 6877 | −.014 | .176 |
| 74 | 6 | 20 | 16.14 | 7261 | −.026 | .335 |
| 64 | 6 | 30 | 16.99 | 7645 | −.036 | .434 |
| 54 | 6 | 40 | 17.84 | 8029 | −.045 | .497 |
| 44 | 6 | 50 | 18.70 | 8413 | −.053 | .540 |
| 34 | 6 | 60 | 19.55 | 8797 | −.060 | .570 |
| 24 | 6 | 70 | 20.40 | 9181 | −.067 | .593 |
| 14 | 6 | 80 | 21.25 | 9565 | −.073 | .610 |
| 4 | 6 | 90 | 22.11 | 9948 | −.078 | .624 |
| 92 | 8 | 0 | 14.82 | 6667 | −.006 | .060 |
| 82 | 8 | 10 | 15.67 | 7051 | −.019 | .270 |
| 72 | 8 | 20 | 16.52 | 7435 | −.030 | .405 |
| 62 | 8 | 30 | 17.38 | 7819 | −.039 | .486 |
| 52 | 8 | 40 | 18.23 | 8203 | −.048 | .536 |
| 42 | 8 | 50 | 19.08 | 8587 | −.055 | .571 |
| 32 | 8 | 60 | 19.94 | 8971 | −.062 | .596 |
| 22 | 8 | 70 | 20.79 | 9355 | −.069 | .615 |
| 12 | 8 | 80 | 21.64 | 9739 | −.074 | .629 |
| 2 | 8 | 90 | 22.49 | 10122 | −.080 | .640 |
| 90 | 10 | 0 | 15.20 | 6841 | −.011 | .164 |
| 80 | 10 | 10 | 16.06 | 7225 | −.023 | .360 |
| 70 | 10 | 20 | 16.91 | 7609 | −.033 | .469 |
| 60 | 10 | 30 | 17.76 | 7993 | −.042 | .532 |
| 50 | 10 | 40 | 18.62 | 8377 | −.050 | .572 |
| 40 | 10 | 50 | 19.47 | 8761 | −.058 | .600 |
| 30 | 10 | 60 | 20.32 | 9145 | −.065 | .620 |
| 20 | 10 | 70 | 21.17 | 9529 | −.071 | .635 |
| 10 | 10 | 80 | 22.03 | 9913 | −.076 | .647 |
| 0 | 10 | 90 | 22.88 | 10296 | −.081 | .656 |
| 88 | 12 | 0 | 15.59 | 7015 | −.015 | .283 |
| 78 | 12 | 10 | 16.44 | 7399 | −.027 | .442 |
| 68 | 12 | 20 | 17.30 | 7783 | −.036 | .525 |
| 58 | 12 | 30 | 18.15 | 8167 | −.045 | .573 |
| 48 | 12 | 40 | 19.00 | 8551 | −.053 | .605 |
| 38 | 12 | 50 | 19.86 | 8935 | −.060 | .626 |
| 28 | 12 | 60 | 20.71 | 9319 | −.067 | .642 |
| 18 | 12 | 70 | 21.56 | 9703 | −.073 | .654 |
| 8 | 12 | 80 | 22.41 | 10086 | −.078 | .663 |
| 86 | 14 | 0 | 15.98 | 7189 | −.020 | .395 |
| 76 | 14 | 10 | 16.83 | 7573 | −.030 | .513 |
| 66 | 14 | 20 | 17.68 | 7957 | −.040 | .574 |
| 56 | 14 | 30 | 18.54 | 8341 | −.048 | .610 |
| 46 | 14 | 40 | 19.39 | 8725 | −.056 | .634 |
| 36 | 14 | 50 | 20.24 | 9109 | −.062 | .650 |
| 26 | 14 | 60 | 21.09 | 9493 | −.069 | .662 |
| 16 | 14 | 70 | 21.95 | 9877 | −.074 | .672 |
| 6 | 14 | 80 | 22.80 | 10260 | −.080 | .679 |
| 84 | 16 | 0 | 16.36 | 7363 | −.023 | .491 |
| 74 | 16 | 10 | 17.22 | 7747 | −.034 | .574 |
| 64 | 16 | 20 | 18.07 | 8131 | −.043 | .617 |
| 54 | 16 | 30 | 18.92 | 8515 | −.051 | .643 |
| 44 | 16 | 40 | 19.78 | 8899 | −.058 | .660 |
| 34 | 16 | 50 | 20.63 | 9283 | −.065 | .672 |
| 24 | 16 | 60 | 21.48 | 9667 | −.071 | .681 |
| 14 | 16 | 70 | 22.33 | 10051 | −.076 | .688 |
| 4 | 16 | 80 | 23.19 | 10434 | −.081 | .693 |
| 82 | 18 | 0 | 16.75 | 7537 | −.027 | .570 |
| 72 | 18 | 10 | 17.60 | 7921 | −.037 | .625 |
| 62 | 18 | 20 | 18.46 | 8305 | −.045 | .654 |
| 52 | 18 | 20 | 18.46 | 8689 | −.053 | .672 |
| 42 | 18 | 40 | 20.16 | 9073 | −.060 | .684 |
| 32 | 18 | 50 | 21.01 | 9457 | −.067 | .692 |
| 22 | 18 | 60 | 21.87 | 9841 | −.072 | .698 |
| 12 | 18 | 70 | 22.72 | 10224 | −.078 | .703 |
| 2 | 18 | 80 | 23.57 | 10608 | −.083 | .707 |

TABLE IX-continued

Magnetization and Temperature Coefficient of (NdDyTm) Alloys
W % $Dy_2Fe_{14}B$+ X % $Nd_2Fe_{14}B$+ Y % $Tm_2Fe_{14}B$

| COMPOSITION | | | M(25C) | M(25C) | ALPHA | |
|---|---|---|---|---|---|---|
| W | X | Y | MB/FU | GAUSS | −50−200 | R SQUARE |
| 80 | 20 | 0 | 17.14 | 7711 | −.031 | .634 |
| 70 | 20 | 10 | 17.99 | 8095 | −.040 | .668 |
| 60 | 20 | 20 | 18.84 | 8479 | −.048 | .687 |
| 50 | 20 | 30 | 19.70 | 8863 | −.056 | .698 |
| 40 | 20 | 40 | 20.55 | 9247 | −.062 | .705 |
| 30 | 20 | 50 | 21.40 | 9631 | −.069 | .710 |
| 20 | 20 | 60 | 22.25 | 10015 | −.074 | .714 |
| 10 | 20 | 70 | 23.11 | 10398 | −.079 | .717 |
| 0 | 20 | 80 | 23.96 | 10782 | −.084 | .720 |

As may be seen from the data presented in Table IX where the Nd is alloyed with Dy and Tm within the cited ranges none of the alloys meet the desired combination of properties.

TABLE X

Magnetization and Temperature Coefficient of $(NdDyTb)_2$ $Fe_{14}B$ Alloys
W % $Dy_2Fe_{14}B$+ X % $Nd_2Fe_{14}B$+ Y % $Tb_2Fe_{14}B$

| COMPOSITION | | | M(25C) | M(25C) | ALPHA | |
|---|---|---|---|---|---|---|
| W | X | Y | MB/FU | GAUSS | −50−200 | R SQUARE |
| 96 | 4 | 0 | 14.04 | 6319 | .004 | .021 |
| 86 | 4 | 10 | 14.04 | 6319 | −.002 | .004 |
| 76 | 4 | 20 | 14.04 | 6319 | −.000 | .000 |
| 66 | 4 | 30 | 14.04 | 6319 | −.003 | .013 |
| 56 | 4 | 40 | 14.04 | 6319 | −.005 | .044 |
| 46 | 4 | 50 | 14.04 | 6319 | −.007 | .097 |
| 36 | 4 | 60 | 14.04 | 6319 | −.009 | .168 |
| 26 | 4 | 70 | 14.04 | 6319 | −.011 | .254 |
| 16 | 4 | 80 | 14.04 | 6319 | −.013 | .349 |
| 6 | 4 | 90 | 14.04 | 6319 | −.015 | .445 |
| 94 | 6 | 0 | 14.43 | 6493 | −.001 | .003 |
| 84 | 6 | 10 | 14.43 | 6493 | −.004 | .020 |
| 74 | 6 | 20 | 14.43 | 6493 | −.006 | .053 |
| 64 | 6 | 30 | 14.43 | 6493 | −.008 | .102 |
| 54 | 6 | 40 | 14.43 | 6493 | −.010 | .167 |
| 44 | 6 | 50 | 14.43 | 6493 | −.012 | .244 |
| 34 | 6 | 60 | 14.43 | 6493 | −.014 | .328 |
| 24 | 6 | 70 | 14.43 | 6493 | −.016 | .416 |
| 14 | 6 | 80 | 14.43 | 6493 | −.018 | .501 |
| 4 | 6 | 90 | 14.43 | 6493 | −.020 | .581 |
| 92 | 88 | 0 | 14.82 | 6667 | −.006 | .060 |
| 82 | 8 | 10 | 14.82 | 6667 | −.008 | .106 |
| 72 | 8 | 20 | 14.82 | 6667 | −.010 | .165 |
| 62 | 8 | 30 | 14.82 | 6667 | −.012 | .235 |
| 52 | 8 | 40 | 14.82 | 6667 | −.014 | .311 |
| 42 | 8 | 50 | 14.82 | 6667 | −.016 | .390 |
| 32 | 8 | 60 | 14.82 | 6667 | −.018 | .469 |
| 22 | 8 | 70 | 14.82 | 6667 | −.020 | .545 |
| 12 | 8 | 80 | 14.82 | 6667 | −.022 | .614 |
| 2 | 8 | 90 | 14.82 | 6667 | −.024 | .677 |
| 90 | 10 | 0 | 15.20 | 6841 | −.011 | .164 |
| 80 | 10 | 10 | 15.20 | 6841 | −.013 | .227 |
| 70 | 10 | 20 | 15.20 | 6841 | −.015 | .296 |
| 60 | 10 | 30 | 15.20 | 6841 | −.017 | .368 |
| 50 | 10 | 40 | 15.20 | 6841 | −.019 | .441 |
| 40 | 10 | 50 | 15.20 | 6841 | −.021 | .512 |
| 30 | 10 | 60 | 15.20 | 6841 | −.022 | .579 |
| 20 | 10 | 70 | 15.20 | 6841 | −.024 | .640 |
| 10 | 10 | 80 | 15.20 | 6841 | −.026 | .696 |
| 0 | 10 | 90 | 15.20 | 6841 | −.028 | .744 |
| 88 | 12 | 0 | 15.59 | 7015 | −.015 | .283 |
| 78 | 12 | 10 | 15.59 | 7015 | −.017 | .349 |
| 68 | 12 | 20 | 15.59 | 7015 | −.019 | .416 |
| 58 | 12 | 30 | 15.59 | 7015 | −.021 | .483 |
| 48 | 12 | 40 | 15.59 | 7015 | −.023 | .546 |
| 38 | 12 | 50 | 15.59 | 7015 | −.025 | .606 |
| 28 | 12 | 60 | 15.59 | 7015 | −.026 | .661 |
| 18 | 12 | 70 | 15.59 | 7015 | −.028 | .710 |
| 8 | 12 | 80 | 15.59 | 7015 | −.030 | .754 |
| 86 | 14 | 0 | 15.98 | 7189 | −.020 | .395 |
| 76 | 14 | 10 | 15.98 | 7189 | −.021 | .457 |
| 66 | 14 | 20 | 15.98 | 7189 | −.023 | .517 |

TABLE X-continued

Magnetization and Temperature Coefficient of $(NdDyTb)_2$ $Fe_{14}B$ Alloys
W % $Dy_2Fe_{14}B$+ X % $Nd_2Fe_{14}B$+ Y % $Tb_2Fe_{14}B$

| COMPOSITION | | | M(25C) | M(25C) | ALPHA | |
|---|---|---|---|---|---|---|
| W | X | Y | MB/FU | GAUSS | −50−200 | R SQUARE |
| 56 | 14 | 30 | 15.98 | 7189 | −.025 | .575 |
| 46 | 14 | 40 | 15.98 | 7189 | −.027 | .628 |
| 36 | 14 | 50 | 15.98 | 7189 | −.028 | .677 |
| 26 | 14 | 60 | 15.98 | 7189 | −.030 | .722 |
| 16 | 14 | 70 | 15.98 | 7189 | −.032 | .762 |
| 6 | 14 | 80 | 15.98 | 7189 | −.034 | .797 |
| 84 | 16 | 0 | 16.36 | 7363 | −.023 | .491 |
| 74 | 16 | 10 | 16.36 | 7363 | −.025 | .546 |
| 64 | 16 | 20 | 16.36 | 7363 | −.027 | .598 |
| 54 | 16 | 30 | 16.36 | 7363 | −.029 | .647 |
| 44 | 16 | 40 | 16.36 | 7363 | −.030 | .691 |
| 34 | 16 | 50 | 16.36 | 7363 | −.032 | .732 |
| 24 | 16 | 60 | 16.36 | 7363 | −.034 | .768 |
| 14 | 16 | 70 | 16.36 | 7363 | −.036 | .800 |
| 4 | 16 | 80 | 16.36 | 7363 | .037 | .829 |
| 82 | 18 | 0 | 16.75 | 7537 | −.027 | .570 |
| 72 | 18 | 10 | 16.75 | 7537 | −.029 | .618 |
| 62 | 18 | 20 | 16.75 | 7537 | −.031 | .662 |
| 52 | 18 | 20 | 16.75 | 7537 | −.032 | .703 |
| 42 | 18 | 40 | 16.75 | 7537 | −.034 | .740 |
| 32 | 18 | 50 | 16.75 | 7537 | −.036 | .773 |
| 22 | 18 | 60 | 16.75 | 7537 | −.037 | .803 |
| 12 | 18 | 70 | 16.75 | 7537 | −.039 | .830 |
| 2 | 18 | 80 | 16.75 | 7537 | −.041 | .854 |
| 80 | 20 | 0 | 17.14 | 7711 | −.031 | .634 |
| 70 | 20 | 10 | 17.14 | 7711 | −.032 | .675 |
| 60 | 20 | 20 | 17.14 | 7711 | −.034 | .712 |
| 50 | 20 | 30 | 17.14 | 7711 | −.036 | .746 |
| 40 | 20 | 40 | 17.14 | 7711 | −.037 | .777 |
| 30 | 20 | 50 | 17.14 | 7711 | −.039 | .805 |
| 20 | 20 | 60 | 17.14 | 7711 | −.041 | .831 |
| 10 | 20 | 70 | 17.14 | 7711 | −.042 | .853 |
| 0 | 20 | 80 | 17.14 | 7711 | −.044 | .873 |

This is also the case with respect to Table X wherein Nd is alloyed with Tb and Dy.

TABLE XI

Magnetization and Temperature Coefficient of $(NdDyGd)_2$ $Fe_{14}B$ Alloys
W % $Dy_2Fe_{14}B$+ X % $Nd_2Fe_{14}B$+ Y % $Gd_2Fe_{14}B$

| COMPOSITION | | | M(25C) | M(25C) | ALPHA | |
|---|---|---|---|---|---|---|
| W | X | Y | MB/FU | GAUSS | −50−200 | R SQUARE |
| 96 | 4 | 0 | 14.04 | 6319 | .004 | .021 |
| 86 | 4 | 10 | 14.37 | 6468 | −.004 | .026 |
| 76 | 4 | 20 | 14.70 | 6616 | −.012 | .177 |
| 66 | 4 | 30 | 15.03 | 6764 | −.019 | .365 |
| 56 | 4 | 40 | 15.36 | 6912 | −.025 | .523 |
| 46 | 4 | 50 | 15.69 | 7061 | −.032 | .639 |
| 36 | 4 | 60 | 16.02 | 7209 | −.038 | .721 |
| 26 | 4 | 70 | 16.35 | 7357 | −.043 | .779 |
| 16 | 4 | 80 | 16.68 | 7505 | −.049 | .821 |
| 6 | 4 | 90 | 17.01 | 7654 | −.054 | .852 |
| 94 | 6 | 0 | 14.43 | 6493 | −.001 | .003 |
| 84 | 6 | 10 | 14.76 | 6642 | −.009 | .113 |
| 74 | 6 | 20 | 15.09 | 6790 | −.016 | .299 |
| 64 | 6 | 30 | 15.42 | 6938 | −.023 | .470 |
| 54 | 6 | 40 | 15.75 | 7086 | −.029 | .600 |
| 44 | 6 | 50 | 16.08 | 7235 | −.035 | .693 |
| 34 | 6 | 60 | 16.41 | 7383 | −.041 | .759 |
| 24 | 6 | 70 | 16.74 | 7531 | −.046 | .806 |
| 14 | 6 | 80 | 17.07 | 7679 | −.052 | .841 |
| 4 | 6 | 90 | 17.39 | 7827 | −.057 | .867 |
| 92 | 8 | 0 | 14.82 | 6667 | −.006 | .060 |
| 82 | 8 | 10 | 15.15 | 6816 | −.014 | .231 |
| 72 | 8 | 20 | 15.48 | 6964 | −.020 | .412 |
| 62 | 8 | 30 | 15.80 | 7112 | −.027 | .557 |
| 52 | 8 | 40 | 14.82 | 7260 | −.033 | .662 |
| 42 | 8 | 50 | 16.13 | 7409 | −.039 | .736 |
| 32 | 8 | 60 | 16.46 | 7557 | −.044 | .789 |
| 22 | 8 | 70 | 16.79 | 7705 | −.049 | .828 |
| 12 | 8 | 80 | 17.12 | 7853 | −.054 | .857 |
| 2 | 8 | 90 | 17.45 | 8001 | −.059 | .879 |
| 90 | 10 | 0 | 17.78 | 6841 | −.011 | .164 |

TABLE XI-continued

Magnetization and Temperature Coefficient of $(NdDyGd)_2 Fe_{14}B$ Alloys
W % $Dy_2Fe_{14}B$+ X % $Nd_2Fe_{14}B$+ Y % $Gd_2Fe_{14}B$

| COMPOSITION | | | M(25C) | M(25C) | ALPHA | |
|---|---|---|---|---|---|---|
| W | X | Y | MB/FU | GAUSS | −50−200 | R SQUARE |
| 80 | 10 | 10 | 15.20 | 6990 | −.018 | .349 |
| 70 | 10 | 20 | 15.53 | 7138 | −.024 | .508 |
| 60 | 10 | 30 | 15.86 | 7286 | −.031 | .626 |
| 50 | 10 | 40 | 16.19 | 7434 | −.036 | .710 |
| 40 | 10 | 50 | 16.52 | 7583 | −.042 | .771 |
| 30 | 10 | 60 | 16.85 | 7731 | −.047 | .814 |
| 20 | 10 | 70 | 17.18 | 7879 | −.052 | .847 |
| 10 | 10 | 80 | 17.51 | 8027 | −.057 | .871 |
| 0 | 10 | 90 | 17.84 | 8175 | −.062 | .890 |
| 88 | 12 | 0 | 18.17 | 7015 | −.015 | .283 |
| 78 | 12 | 10 | 15.59 | 7164 | −.022 | .454 |
| 68 | 12 | 20 | 15.92 | 7312 | −.028 | .586 |
| 58 | 12 | 30 | 16.25 | 7460 | −.034 | .681 |
| 48 | 12 | 40 | 16.58 | 7608 | −.040 | .749 |
| 38 | 12 | 50 | 16.91 | 7756 | −.045 | .799 |
| 28 | 12 | 60 | 17.24 | 7905 | −.050 | .835 |
| 18 | 12 | 70 | 17.57 | 8053 | −.055 | .862 |
| 8 | 12 | 80 | 17.90 | 8201 | −.060 | .883 |
| 86 | 14 | 0 | 18.22 | 7189 | −.020 | .395 |
| 76 | 14 | 10 | 15.98 | 7338 | −.026 | .541 |
| 66 | 14 | 20 | 16.31 | 7486 | −.032 | .649 |
| 56 | 14 | 30 | 16.64 | 7634 | −.037 | .726 |
| 46 | 14 | 40 | 16.96 | 7782 | −.043 | .781 |
| 36 | 14 | 50 | 17.29 | 7930 | −.048 | .822 |
| 26 | 14 | 60 | 17.95 | 8079 | −.053 | .852 |
| 16 | 14 | 70 | 18.28 | 8227 | −.058 | .875 |
| 6 | 14 | 80 | 18.61 | 8375 | −.062 | .893 |
| 84 | 16 | 0 | 16.36 | 7363 | −.023 | .491 |
| 74 | 16 | 10 | 16.69 | 7511 | −.029 | .612 |
| 64 | 16 | 20 | 17.02 | 7660 | −.035 | .699 |
| 54 | 16 | 30 | 17.35 | 7808 | −.041 | .761 |
| 44 | 16 | 40 | 17.68 | 7956 | −.046 | .807 |
| 34 | 16 | 50 | 18.01 | 8104 | −.051 | .841 |
| 24 | 16 | 60 | 18.34 | 8253 | −.056 | .866 |
| 14 | 16 | 70 | 18.67 | 8401 | −.060 | .886 |
| 4 | 16 | 80 | 19.00 | 8549 | −.064 | .901 |
| 82 | 18 | 0 | 16.75 | 7537 | −.027 | .570 |
| 72 | 18 | 10 | 17.08 | 7685 | −.033 | .668 |
| 62 | 18 | 20 | 17.41 | 7834 | −.038 | .739 |
| 52 | 18 | 20 | 17.74 | 7982 | −.044 | .790 |
| 42 | 18 | 40 | 18.07 | 8130 | −.049 | .828 |
| 32 | 18 | 50 | 18.40 | 8278 | −.054 | .856 |
| 22 | 18 | 60 | 18.73 | 8427 | −.058 | .878 |
| 12 | 18 | 70 | 19.06 | 8575 | −.062 | .895 |
| 2 | 18 | 80 | 19.38 | 8723 | −.067 | .909 |
| 80 | 20 | 0 | 17.14 | 7711 | −.031 | .634 |
| 70 | 20 | 10 | 17.47 | 7859 | −.036 | .714 |
| 60 | 20 | 20 | 17.79 | 8008 | −.042 | .772 |
| 50 | 20 | 30 | 18.12 | 8156 | −.047 | .814 |
| 40 | 20 | 40 | 18.45 | 8304 | −.051 | .846 |
| 30 | 20 | 50 | 18.78 | 8452 | −.056 | .870 |
| 20 | 20 | 60 | 19.11 | 8601 | −.060 | .889 |
| 10 | 20 | 70 | 19.44 | 8749 | −.065 | .903 |
| 0 | 20 | 80 | 19.77 | 8897 | −.069 | .915 |

The Table XI the alloy compositions embodying Dy and Gd with neodynium do not provide alloys that meet the desired combination of properties.

TABLE XII

Magnetization and Temperature Coefficient of $(NdHoTm)_2 Fe_{14}B$ Alloys
W % $Ho_2Fe_{14}B$+ X % $Nd_2Fe_{14}B$+ Y % $Tm_2Fe_{14}B$

| COMPOSITION | | | M(25C) | M(25C) | ALPHA | |
|---|---|---|---|---|---|---|
| W | X | Y | MB/FU | GAUSS | −50−200 | R SQUARE |
| 96 | 4 | 0 | 16.36 | 7364 | .006 | .024 |
| 86 | 4 | 10 | 16.97 | 7639 | −.007 | .029 |
| 76 | 4 | 20 | 17.59 | 7914 | −.018 | .150 |
| 66 | 4 | 30 | 18.20 | 8189 | −.029 | .274 |
| 56 | 4 | 40 | 18.81 | 8464 | −.038 | .371 |
| 46 | 4 | 50 | 19.42 | 8739 | −.047 | .445 |
| 36 | 4 | 60 | 20.03 | 9014 | −.055 | .500 |
| 26 | 4 | 70 | 20.64 | 9289 | −.062 | .542 |

TABLE XII-continued

Magnetization and Temperature Coefficient of $(NdHoTm)_2 Fe_{14}B$ Alloys
W % $Ho_2Fe_{14}B$+ X % $Nd_2Fe_{14}B$+ Y % $Tm_2Fe_{14}B$

| COMPOSITION | | | M(25C) | M(25C) | ALPHA | |
|---|---|---|---|---|---|---|
| W | X | Y | MB/FU | GAUSS | −50−200 | R SQUARE |
| 16 | 4 | 80 | 21.25 | 9565 | −.069 | .575 |
| 6 | 4 | 90 | 21.87 | 9840 | −.076 | .601 |
| 94 | 6 | 0 | 16.70 | 7516 | −.001 | .001 |
| 84 | 6 | 10 | 17.31 | 7791 | −.011 | .074 |
| 74 | 6 | 20 | 17.92 | 8066 | −.022 | .211 |
| 64 | 6 | 30 | 18.54 | 8341 | −.032 | .329 |
| 54 | 6 | 40 | 19.15 | 8616 | −.041 | .417 |
| 44 | 6 | 50 | 19.76 | 8891 | −.050 | .482 |
| 34 | 6 | 60 | 20.37 | 9167 | −.057 | .531 |
| 24 | 6 | 70 | 20.98 | 9442 | −.065 | .568 |
| 14 | 6 | 80 | 21.59 | 9717 | −.071 | .597 |
| 4 | 6 | 90 | 22.20 | 9992 | −.078 | .621 |
| 92 | 8 | 0 | 17.04 | 7668 | −.003 | .010 |
| 82 | 8 | 10 | 17.65 | 7943 | −.015 | .133 |
| 72 | 8 | 20 | 18.26 | 8218 | −.025 | .274 |
| 62 | 8 | 30 | 18.87 | 8493 | −.035 | .382 |
| 52 | 8 | 40 | 19.49 | 8769 | −.044 | .460 |
| 42 | 8 | 50 | 20.10 | 9044 | −.052 | .518 |
| 32 | 8 | 60 | 20.71 | 9319 | −.060 | .560 |
| 22 | 8 | 70 | 21.32 | 9594 | −.067 | .593 |
| 12 | 8 | 80 | 21.93 | 9869 | −.073 | .618 |
| 2 | 8 | 90 | 22.54 | 10144 | −.080 | .639 |
| 90 | 10 | 0 | 17.38 | 7820 | −.008 | .049 |
| 80 | 10 | 10 | 17.99 | 8095 | −.019 | .201 |
| 70 | 10 | 20 | 18.60 | 8370 | −.029 | .335 |
| 60 | 10 | 30 | 19.21 | 8646 | −.038 | .432 |
| 50 | 10 | 40 | 19.82 | 8921 | −.047 | .501 |
| 40 | 10 | 50 | 20.44 | 9196 | −.055 | .550 |
| 30 | 10 | 60 | 21.05 | 9471 | −.062 | .587 |
| 20 | 10 | 70 | 21.66 | 9746 | −.069 | .616 |
| 10 | 10 | 80 | 22.27 | 10021 | −.075 | .638 |
| 0 | 10 | 90 | 22.88 | 10296 | −.081 | .656 |
| 88 | 12 | 0 | 17.72 | 7972 | −.012 | .111 |
| 78 | 12 | 10 | 18.33 | 8248 | −.022 | .272 |
| 68 | 12 | 20 | 18.94 | 8523 | −.032 | .394 |
| 58 | 12 | 30 | 19.55 | 8798 | −.041 | .478 |
| 48 | 12 | 40 | 20.16 | 9073 | −.049 | .538 |
| 38 | 12 | 50 | 20.77 | 9348 | −.057 | .580 |
| 28 | 12 | 60 | 21.38 | 9623 | −.064 | .612 |
| 18 | 12 | 70 | 22.00 | 9898 | −.071 | .637 |
| 8 | 12 | 80 | 22.61 | 10173 | −.077 | .657 |
| 86 | 14 | 0 | 18.05 | 8125 | −.016 | .187 |
| 76 | 14 | 10 | 18.67 | 8400 | −.026 | .342 |
| 66 | 14 | 20 | 19.28 | 8675 | −.035 | .449 |
| 56 | 14 | 30 | 18.89 | 8950 | −.044 | .521 |
| 46 | 14 | 40 | 20.50 | 9225 | −.052 | .572 |
| 36 | 14 | 50 | 21.11 | 9500 | −.059 | .608 |
| 26 | 14 | 60 | 21.72 | 9775 | −.066 | .636 |
| 16 | 14 | 70 | 22.33 | 10051 | −.073 | .657 |
| 6 | 14 | 80 | 22.95 | 10326 | −.079 | .674 |
| 84 | 16 | 0 | 18.39 | 8277 | −.019 | .269 |
| 74 | 16 | 10 | 19.00 | 8552 | −.029 | .408 |
| 64 | 16 | 20 | 19.62 | 8827 | −.038 | .499 |
| 54 | 16 | 30 | 20.23 | 9102 | −.047 | .560 |
| 44 | 16 | 40 | 20.84 | 9377 | −.054 | .603 |
| 34 | 16 | 50 | 21.45 | 9653 | −.062 | .634 |
| 24 | 16 | 60 | 22.06 | 9928 | −.069 | .658 |
| 14 | 16 | 70 | 22.67 | 10203 | −.075 | .676 |
| 4 | 16 | 80 | 23.28 | 10478 | −.081 | .690 |
| 82 | 18 | 0 | 18.73 | 8429 | −.023 | .349 |
| 72 | 18 | 10 | 19.34 | 8704 | −.032 | .469 |
| 62 | 18 | 20 | 19.95 | 8979 | −.041 | .545 |
| 52 | 18 | 20 | 20.57 | 9254 | −.049 | .596 |
| 42 | 18 | 40 | 21.18 | 9530 | −.057 | .632 |
| 32 | 18 | 50 | 21.79 | 9805 | −.064 | .658 |
| 22 | 18 | 60 | 22.40 | 10080 | −.071 | .678 |
| 12 | 18 | 70 | 23.01 | 10355 | −.077 | .693 |
| 2 | 18 | 80 | 23.62 | 10630 | −.082 | .706 |
| 80 | 20 | 0 | 19.07 | 8581 | −.026 | .424 |
| 70 | 20 | 10 | 19.68 | 8856 | −.035 | .523 |
| 60 | 20 | 20 | 20.29 | 9132 | −.044 | .586 |
| 50 | 20 | 30 | 20.90 | 9407 | −.052 | .628 |
| 40 | 20 | 40 | 21.52 | 9682 | −.059 | .658 |
| 30 | 20 | 50 | 22.13 | 9957 | −.066 | .680 |
| 20 | 20 | 60 | 22.74 | 10232 | −.072 | .696 |
| 10 | 20 | 70 | 23.35 | 10507 | −.078 | .709 |

TABLE XII-continued

Magnetization and Temperature Coefficient of $(NdHoTm)_2 Fe_{14}B$ Alloys
W % $Ho_2Fe_{14}B$+ X % $Nd_2Fe_{14}B$+ Y % $Tm_2Fe_{14}B$

| COMPOSITION | | | M(25C) | M(25C) | ALPHA | |
|---|---|---|---|---|---|---|
| W | X | Y | MB/FU | GAUSS | −50−200 | R SQUARE |
| 0 | 20 | 80 | 23.96 | 10782 | −.084 | .720 |

As can be seen from the data presented in Table XII with neodynium within the range of 4 to 10%, Tm can be varied from 0 to 13% in combination with Nd and Ho within the range of 83 to 96% to achieve the desired combination of properties.

TABLE XIII

Magnetization and Temperature Coefficient of $(NdHoEr)_2 Fe_{14}B$ Alloys
W % $Ho_2Fe_{14}B$+ X % $Nd_2Fe_{14}B$+ Y % $Er_2Fe_{14}B$

| COMPOSITION | | | M(25C) | M(25C) | ALPHA | |
|---|---|---|---|---|---|---|
| W | X | Y | MB/FU | GAUSS | −50-200 | R SQUARE |
| 96 | 4 | 0 | 16.36 | 7364 | .006 | .024 |
| 86 | 4 | 10 | 16.55 | 7447 | −.001 | .000 |
| 76 | 4 | 20 | 16.73 | 7530 | −.007 | .024 |
| 66 | 4 | 30 | 16.92 | 7613 | −.012 | .070 |
| 56 | 4 | 40 | 17.10 | 8305 | −.018 | .122 |
| 46 | 4 | 50 | 17.29 | 7780 | −.024 | .173 |
| 36 | 4 | 60 | 17.47 | 7863 | −.029 | .220 |
| 26 | 4 | 70 | 17.66 | 7946 | −.034 | .261 |
| 16 | 4 | 80 | 17.84 | 8029 | −.039 | .297 |
| 6 | 4 | 90 | 18.03 | 8112 | −.044 | .328 |
| 94 | 6 | 0 | 16.70 | 7516 | .001 | .001 |
| 84 | 6 | 10 | 16.89 | 7599 | −.005 | .017 |
| 74 | 6 | 20 | 17.07 | 7682 | −.011 | .064 |
| 64 | 6 | 30 | 17.26 | 7765 | −.016 | .120 |
| 54 | 6 | 40 | 17.44 | 7849 | −.022 | .176 |
| 44 | 6 | 50 | 17.63 | 7932 | −.027 | .226 |
| 34 | 6 | 60 | 17.81 | 8015 | −.032 | .269 |
| 24 | 6 | 70 | 18.00 | 8098 | −.037 | .307 |
| 14 | 6 | 80 | 18.18 | 8181 | −.042 | .340 |
| 4 | 6 | 90 | 18.37 | 8265 | −.047 | .368 |
| 92 | 8 | 0 | 17.04 | 7668 | −.003 | .010 |
| 82 | 8 | 10 | 17.22 | 7751 | −.009 | .057 |
| 72 | 8 | 20 | 17.41 | 7834 | −.015 | .118 |
| 62 | 8 | 30 | 17.59 | 7918 | −.020 | .178 |
| 52 | 8 | 40 | 17.78 | 8001 | −.026 | .232 |
| 42 | 8 | 50 | 17.96 | 8084 | −.031 | .279 |
| 32 | 8 | 60 | 18.15 | 8167 | −.036 | .318 |
| 22 | 8 | 70 | 18.33 | 8250 | −.041 | .352 |
| 12 | 8 | 80 | 18.52 | 8334 | −.045 | .381 |
| 2 | 8 | 90 | 18.70 | 8417 | −.050 | .406 |
| 90 | 10 | 0 | 17.38 | 7820 | −.008 | .049 |
| 80 | 10 | 10 | 17.56 | 7903 | −.013 | .115 |
| 70 | 10 | 20 | 17.75 | 7987 | −.019 | .181 |
| 60 | 10 | 30 | 17.93 | 8070 | −.024 | .240 |
| 50 | 10 | 40 | 18.12 | 8153 | −.029 | .289 |
| 40 | 10 | 50 | 18.30 | 8236 | −.034 | .331 |
| 30 | 10 | 60 | 18.49 | 8319 | −.039 | .366 |
| 20 | 10 | 70 | 18.67 | 8403 | −.044 | .396 |
| 10 | 10 | 80 | 18.86 | 8486 | −.048 | .421 |
| 0 | 10 | 90 | 19.04 | 8569 | −.053 | .442 |
| 88 | 12 | 0 | 17.72 | 7972 | −.012 | .111 |
| 78 | 12 | 10 | 17.90 | 8056 | −.017 | .184 |
| 68 | 12 | 20 | 18.09 | 8139 | −.022 | .248 |
| 58 | 12 | 30 | 18.27 | 8222 | −.027 | .302 |
| 48 | 12 | 40 | 18.46 | 8305 | −.032 | .345 |
| 38 | 12 | 50 | 18.64 | 8388 | −.037 | .382 |
| 28 | 12 | 60 | 18.83 | 8472 | −.042 | .412 |
| 18 | 12 | 70 | 19.01 | 8555 | −.046 | .437 |
| 8 | 12 | 80 | 19.20 | 8638 | −.051 | .458 |
| 86 | 14 | 0 | 18.05 | 8125 | −.016 | .187 |
| 76 | 14 | 10 | 18.24 | 8208 | −.021 | .258 |
| 66 | 14 | 20 | 18.42 | 8291 | −.026 | .315 |
| 56 | 14 | 30 | 18.61 | 8374 | −.031 | .362 |
| 46 | 14 | 40 | 18.79 | 8457 | −.036 | .399 |
| 36 | 14 | 50 | 18.98 | 8541 | −.040 | .429 |
| 26 | 14 | 60 | 19.16 | 8624 | −.045 | .454 |
| 16 | 14 | 70 | 19.35 | 8707 | −.049 | .475 |
| 6 | 14 | 80 | 19.53 | 8790 | −.054 | .493 |
| 84 | 16 | 0 | 18.39 | 8277 | −.019 | .269 |

TABLE XIII-continued

Magnetization and Temperature Coefficient of $(NdHoEr)_2 Fe_{14}B$ Alloys
W % $Ho_2Fe_{14}B$+ X % $Nd_2Fe_{14}B$+ Y % $Er_2Fe_{14}B$

| COMPOSITION | | | M(25C) | M(25C) | ALPHA | |
|---|---|---|---|---|---|---|
| W | X | Y | MB/FU | GAUSS | −50-200 | R SQUARE |
| 74 | 16 | 10 | 18.58 | 8360 | −.024 | .331 |
| 64 | 16 | 20 | 18.76 | 8443 | −.029 | .380 |
| 54 | 16 | 30 | 18.95 | 8527 | −.034 | .418 |
| 44 | 16 | 40 | 19.13 | 8610 | −.039 | .449 |
| 34 | 16 | 50 | 19.32 | 8693 | −.043 | .474 |
| 24 | 16 | 60 | 19.50 | 8776 | −.048 | .494 |
| 14 | 16 | 70 | 19.69 | 8859 | −.052 | .511 |
| 4 | 16 | 80 | 19.87 | 8943 | −.056 | .526 |
| 82 | 18 | 0 | 18.73 | 8429 | −.023 | .349 |
| 72 | 18 | 10 | 18.92 | 8512 | −.028 | .401 |
| 62 | 18 | 20 | 19.10 | 8596 | −.032 | .440 |
| 52 | 18 | 20 | 19.29 | 8679 | −.037 | .471 |
| 42 | 18 | 40 | 19.47 | 8762 | −.042 | .495 |
| 32 | 18 | 50 | 19.66 | 8845 | −.046 | .515 |
| 22 | 18 | 60 | 19.84 | 8928 | −.050 | .531 |
| 12 | 18 | 70 | 20.03 | 9012 | −.055 | .545 |
| 2 | 18 | 80 | 20.21 | 9095 | −.059 | .557 |
| 80 | 20 | 0 | 19.07 | 8581 | −.026 | .424 |
| 70 | 20 | 10 | 19.25 | 8665 | −.031 | .464 |
| 60 | 20 | 20 | 19.44 | 8748 | −.036 | .495 |
| 50 | 20 | 30 | 19.62 | 8831 | −.040 | .519 |
| 40 | 20 | 40 | 19.81 | 8914 | −.045 | .538 |
| 30 | 20 | 50 | 19.99 | 8997 | −.049 | .553 |
| 20 | 20 | 60 | 20.18 | 9081 | −.053 | .565 |
| 10 | 20 | 70 | 20.36 | 9164 | −.057 | .576 |
| 0 | 20 | 80 | 20.55 | 9247 | −.061 | .585 |

As may be seen from the data presented in this Table, if Nd varies from 5 to 11%, Er from 0 and Ho from 76 to 94%, the alloys meet the desired combination of properties.

TABLE XIV

Magnetization and Temperature Coefficient of $(NdHoTb)_2 Fe_{14}B$ Alloys
W % $Ho_2Fe_{14}B$+ X % $Nd_2Fe_{14}B$+ Y % $Tb_2Fe_{14}B$

| COMPOSITION | | | M(25C) | M(25C) | ALPHA | |
|---|---|---|---|---|---|---|
| W | X | Y | MB/FU | GAUSS | −50-200 | R SQUARE |
| 96 | 4 | 0 | 16.36 | 7364 | .006 | .024 |
| 86 | 4 | 10 | 16.12 | 7255 | .004 | .011 |
| 76 | 4 | 20 | 15.88 | 7146 | .002 | .002 |
| 66 | 4 | 30 | 15.64 | 7037 | −.001 | .000 |
| 56 | 4 | 40 | 15.40 | 6929 | −.003 | .010 |
| 46 | 4 | 50 | 15.16 | 6820 | −.005 | .037 |
| 36 | 4 | 60 | 14.91 | 6711 | −.007 | .087 |
| 26 | 4 | 70 | 14.67 | 6602 | −.010 | .167 |
| 16 | 4 | 80 | 14.43 | 6493 | −.012 | .278 |
| 6 | 4 | 90 | 14.19 | 6385 | −.015 | .414 |
| 94 | 6 | 0 | 16.70 | 7516 | .001 | .001 |
| 84 | 6 | 10 | 16.46 | 7407 | −.001 | .001 |
| 74 | 6 | 20 | 16.22 | 7298 | −.003 | .010 |
| 64 | 6 | 30 | 15.98 | 7190 | −.005 | .031 |
| 54 | 6 | 40 | 15.73 | 7081 | −.008 | .069 |
| 44 | 6 | 50 | 15.49 | 6972 | −.010 | .128 |
| 34 | 6 | 60 | 15.25 | 6863 | −.012 | .209 |
| 24 | 6 | 70 | 15.01 | 6754 | −.014 | .314 |
| 14 | 6 | 80 | 14.77 | 6646 | −.017 | .435 |
| 4 | 6 | 90 | 14.53 | 6537 | −.019 | .561 |
| 92 | 8 | 0 | 17.04 | 7668 | −.003 | .010 |
| 82 | 8 | 10 | 16.80 | 7559 | −.005 | .027 |
| 72 | 8 | 20 | 16.56 | 7450 | −.008 | .057 |
| 62 | 8 | 30 | 16.31 | 7342 | −.010 | .102 |
| 52 | 8 | 40 | 16.07 | 7233 | −.012 | .164 |
| 42 | 8 | 50 | 15.83 | 7124 | −.014 | .244 |
| 32 | 8 | 60 | 15.59 | 7015 | −.017 | .341 |
| 22 | 8 | 70 | 15.35 | 6907 | −.019 | .449 |
| 12 | 8 | 80 | 15.11 | 6798 | −.021 | .561 |
| 2 | 8 | 90 | 14.86 | 6689 | −.024 | .668 |
| 90 | 10 | 0 | 17.38 | 7820 | −.008 | .049 |
| 80 | 10 | 10 | 17.14 | 7711 | −.010 | .084 |
| 70 | 10 | 20 | 16.89 | 7603 | −.012 | .133 |
| 60 | 10 | 30 | 16.65 | 7494 | −.014 | .196 |
| 50 | 10 | 40 | 16.41 | 7385 | −.016 | .273 |

TABLE XIV-continued

Magnetization and Temperature Coefficient of $(NdHoTb)_2 Fe_{14}B$ Alloys
W % $Ho_2Fe_{14}B$+ X % $Nd_2Fe_{14}B$+ Y % $Tb_2Fe_{14}B$

| COMPOSITION | | | M(25C) | M(25C) | ALPHA | |
|---|---|---|---|---|---|---|
| W | X | Y | MB/FU | GAUSS | −50–200 | R SQUARE |
| 40 | 10 | 50 | 16.17 | 7276 | −.018 | .363 |
| 30 | 10 | 60 | 15.93 | 7168 | −.021 | .460 |
| 20 | 10 | 70 | 15.69 | 7059 | −.023 | .560 |
| 10 | 10 | 80 | 15.44 | 6950 | −.026 | .657 |
| 0 | 10 | 90 | 15.20 | 6841 | −.028 | .744 |
| 88 | 12 | 0 | 17.72 | 7972 | −.012 | .111 |
| 78 | 12 | 10 | 17.47 | 8056 | −.014 | .162 |
| 68 | 12 | 20 | 17.23 | 7755 | −.016 | .224 |
| 58 | 12 | 30 | 16.99 | 7646 | −.018 | .297 |
| 48 | 12 | 40 | 16.75 | 7537 | −.020 | .380 |
| 38 | 12 | 50 | 16.51 | 7429 | −.022 | .468 |
| 28 | 12 | 60 | 16.27 | 7320 | −.025 | .559 |
| 18 | 12 | 70 | 16.02 | 7211 | −.027 | .647 |
| 8 | 12 | 80 | 15.78 | 7102 | −.030 | .728 |
| 86 | 14 | 0 | 18.05 | 8125 | −.016 | .187 |
| 76 | 14 | 10 | 17.81 | 8016 | −.018 | .248 |
| 66 | 14 | 20 | 17.57 | 7907 | −.020 | .317 |
| 56 | 14 | 30 | 17.33 | 7798 | −.022 | .394 |
| 46 | 14 | 40 | 17.09 | 7690 | −.024 | .475 |
| 36 | 14 | 50 | 16.85 | 7581 | −.026 | .558 |
| 26 | 14 | 60 | 16.60 | 7472 | −.029 | .638 |
| 16 | 14 | 70 | 16.36 | 7363 | −.031 | .713 |
| 6 | 14 | 80 | 16.12 | 7255 | −.033 | .780 |
| 84 | 16 | 0 | 18.39 | 8277 | −.019 | .269 |
| 74 | 16 | 10 | 18.15 | 8168 | −.021 | .334 |
| 64 | 16 | 20 | 17.91 | 8059 | −.023 | .406 |
| 54 | 16 | 30 | 17.67 | 7951 | −.026 | .480 |
| 44 | 16 | 40 | 17.43 | 7842 | −.028 | .556 |
| 34 | 16 | 50 | 17.18 | 7733 | −.030 | .630 |
| 24 | 16 | 60 | 16.94 | 7624 | −.032 | .700 |
| 14 | 16 | 70 | 16.70 | 7516 | −.035 | .764 |
| 4 | 16 | 80 | 16.46 | 7407 | −.037 | .820 |
| 82 | 18 | 0 | 18.73 | 8429 | −.023 | .349 |
| 72 | 18 | 10 | 18.49 | 8320 | −.025 | .416 |
| 62 | 18 | 20 | 18.25 | 8212 | −.027 | .485 |
| 52 | 18 | 20 | 18.01 | 8103 | −.029 | .555 |
| 42 | 18 | 40 | 17.76 | 7994 | −.031 | .623 |
| 32 | 18 | 50 | 17.52 | 7885 | −.033 | .689 |
| 22 | 18 | 60 | 17.28 | 7777 | −.036 | .749 |
| 12 | 18 | 70 | 17.04 | 7668 | −.038 | .803 |
| 2 | 18 | 80 | 16.80 | 7559 | −.040 | .850 |
| 80 | 20 | 0 | 19.07 | 8581 | −.026 | .424 |
| 70 | 20 | 10 | 18.83 | 8473 | −.028 | .488 |
| 60 | 20 | 20 | 18.59 | 8364 | −.030 | .553 |
| 50 | 20 | 30 | 18.34 | 8255 | −.032 | .617 |
| 40 | 20 | 40 | 18.10 | 8146 | −.035 | .679 |
| 30 | 20 | 50 | 17.86 | 8037 | −.037 | .736 |
| 20 | 20 | 60 | 17.62 | 7929 | −.039 | .787 |
| 10 | 20 | 70 | 17.38 | 7820 | −.041 | .833 |
| 0 | 20 | 80 | 17.14 | 7711 | −.044 | .873 |

Table XIV shows that with Nd within the range of 7 to 11% the properties are obtained if Ho is maintained within the range of 78 to 90% and Tb varies 9 to 12%.

TABLE XV

Magnetization and Temperature Coefficient of $(NdHoDy)_2 Fe_{14}B$ Alloys
W % $Ho_2Fe_{14}B$+ X % $Nd_2Fe_{14}B$+ Y % $Dy_2Fe_{14}B$

| COMPOSITION | | | M(25C) | M(25C) | ALPHA | |
|---|---|---|---|---|---|---|
| W | X | Y | MB/FU | GAUSS | −50–200 | R SQUARE |
| 96 | 4 | 0 | 16.36 | 7364 | .006 | .024 |
| 86 | 4 | 10 | 16.12 | 7255 | .005 | .024 |
| 76 | 4 | 20 | 15.88 | 7146 | .005 | .024 |
| 66 | 4 | 30 | 15.64 | 7037 | −.005 | .023 |
| 56 | 4 | 40 | 15.40 | 6929 | −.005 | .023 |
| 46 | 4 | 50 | 15.16 | 6820 | −.005 | .023 |
| 36 | 4 | 60 | 14.91 | 6711 | −.005 | .022 |
| 26 | 4 | 70 | 14.67 | 6602 | −.004 | .022 |
| 16 | 4 | 80 | 14.43 | 6493 | −.004 | .021 |
| 6 | 4 | 90 | 14.19 | 6385 | −.004 | .021 |
| 94 | 6 | 0 | 16.70 | 7516 | .001 | .001 |

TABLE XV-continued

Magnetization and Temperature Coefficient of $(NdHoDy)_2 Fe_{14}B$ Alloys
W % $Ho_2Fe_{14}B$+ X % $Nd_2Fe_{14}B$+ Y % $Dy_2Fe_{14}B$

| COMPOSITION | | | M(25C) | M(25C) | ALPHA | |
|---|---|---|---|---|---|---|
| W | X | Y | MB/FU | GAUSS | −50–200 | R SQUARE |
| 84 | 6 | 10 | 16.46 | 7407 | −.001 | .001 |
| 74 | 6 | 20 | 16.22 | 7298 | −.001 | .000 |
| 64 | 6 | 30 | 15.98 | 7190 | −.000 | .000 |
| 54 | 6 | 40 | 15.73 | 7081 | −.000 | .000 |
| 44 | 6 | 50 | 15.49 | 6972 | −.000 | .000 |
| 34 | 6 | 60 | 15.25 | 6863 | −.000 | .000 |
| 24 | 6 | 70 | 15.01 | 6754 | −.001 | .001 |
| 14 | 6 | 80 | 14.77 | 6646 | −.001 | .001 |
| 4 | 6 | 90 | 14.53 | 6537 | −.001 | .003 |
| 92 | 8 | 0 | 17.04 | 7668 | −.003 | .010 |
| 82 | 8 | 10 | 16.80 | 7559 | −.004 | .012 |
| 72 | 8 | 20 | 16.56 | 7450 | −.004 | .018 |
| 62 | 8 | 30 | 16.31 | 7342 | −.004 | .022 |
| 52 | 8 | 40 | 16.07 | 7233 | −.005 | .027 |
| 42 | 8 | 50 | 15.83 | 7124 | −.005 | .033 |
| 32 | 8 | 60 | 15.59 | 7015 | −.005 | .039 |
| 22 | 8 | 70 | 15.35 | 6907 | −.006 | .048 |
| 12 | 8 | 80 | 15.11 | 6798 | −.006 | .058 |
| 2 | 8 | 90 | 14.86 | 6689 | −.006 | .049 |
| 90 | 10 | 0 | 17.38 | 7820 | −.008 | .056 |
| 80 | 10 | 10 | 17.14 | 7711 | −.008 | .064 |
| 70 | 10 | 20 | 16.89 | 7603 | −.008 | .073 |
| 60 | 10 | 30 | 16.65 | 7494 | −.009 | .083 |
| 50 | 10 | 40 | 16.41 | 7385 | −.009 | .095 |
| 40 | 10 | 50 | 16.17 | 7276 | −.009 | .109 |
| 30 | 10 | 60 | 15.93 | 7168 | −.010 | .125 |
| 20 | 10 | 70 | 15.69 | 7059 | −.010 | .143 |
| 10 | 10 | 80 | 15.44 | 6950 | −.011 | .164 |
| 0 | 10 | 90 | 15.20 | 6841 | −.011 | .111 |
| 88 | 12 | 0 | 17.72 | 7972 | −.012 | .123 |
| 78 | 12 | 10 | 17.47 | 7864 | −.012 | .137 |
| 68 | 12 | 20 | 17.23 | 7755 | −.012 | .152 |
| 58 | 12 | 30 | 16.99 | 7646 | −.013 | .169 |
| 48 | 12 | 40 | 16.75 | 7537 | −.013 | .188 |
| 38 | 12 | 50 | 16.51 | 7429 | −.014 | .210 |
| 28 | 12 | 60 | 16.27 | 7320 | −.014 | .233 |
| 18 | 12 | 70 | 16.02 | 7211 | −.015 | .260 |
| 8 | 12 | 80 | 15.78 | 7102 | −.015 | .187 |
| 86 | 14 | 0 | 18.05 | 8125 | −.016 | .204 |
| 76 | 14 | 10 | 17.81 | 8016 | −.016 | .223 |
| 66 | 14 | 20 | 17.57 | 7907 | −.016 | .243 |
| 56 | 14 | 30 | 17.33 | 7798 | −.017 | .266 |
| 46 | 14 | 40 | 17.09 | 7690 | −.017 | .475 |
| 36 | 14 | 50 | 16.85 | 7581 | −.018 | .290 |
| 26 | 14 | 60 | 16.60 | 7472 | −.018 | .316 |
| 16 | 14 | 70 | 16.36 | 7363 | −.019 | .344 |
| 6 | 14 | 80 | 16.12 | 7255 | −.019 | .375 |
| 84 | 16 | 0 | 18.39 | 8277 | −.019 | .269 |
| 74 | 16 | 10 | 18.15 | 8168 | −.020 | .289 |
| 64 | 16 | 20 | 17.91 | 8059 | −.020 | .312 |
| 54 | 16 | 30 | 17.67 | 7951 | −.021 | .335 |
| 44 | 16 | 40 | 17.43 | 7842 | −.021 | .360 |
| 34 | 16 | 50 | 17.18 | 7733 | −.022 | .387 |
| 24 | 16 | 60 | 16.94 | 7624 | −.022 | .416 |
| 14 | 16 | 70 | 16.70 | 7516 | −.023 | .446 |
| 4 | 16 | 80 | 16.46 | 7407 | −.023 | .478 |
| 82 | 18 | 0 | 18.73 | 8429 | −.023 | .349 |
| 72 | 18 | 10 | 18.49 | 8320 | −.023 | .372 |
| 62 | 18 | 20 | 18.25 | 8212 | −.024 | .396 |
| 52 | 18 | 20 | 18.01 | 8103 | −.024 | .421 |
| 42 | 18 | 40 | 17.76 | 7994 | −.025 | .447 |
| 32 | 18 | 50 | 17.52 | 7885 | −.025 | .475 |
| 22 | 18 | 60 | 17.28 | 7777 | −.026 | .504 |
| 12 | 18 | 70 | 17.04 | 7668 | −.026 | .533 |
| 2 | 18 | 80 | 16.80 | 7559 | −.027 | .564 |
| 80 | 20 | 0 | 19.07 | 8581 | −.026 | .424 |
| 70 | 20 | 10 | 18.83 | 8473 | −.027 | .447 |
| 60 | 20 | 20 | 18.59 | 8364 | −.027 | .472 |
| 50 | 20 | 30 | 18.34 | 8255 | −.028 | .497 |
| B0 | 20 | 40 | 18.10 | 8146 | −.028 | .523 |
| 30 | 20 | 50 | 17.86 | 8037 | −.029 | .550 |
| 20 | 20 | 60 | 17.62 | 7929 | −.029 | .578 |
| 10 | 20 | 70 | 17.38 | 7820 | −.030 | .606 |
| 0 | 20 | 80 | 17.14 | 7711 | −.031 | .634 |

In Table XV the desired combination of properties are achieved with alloys containing the addition of 7 to 11%, Ho 75 to 90%, and Dy within the range of 0 to 15%.

TABLE XVI

Magnetization and Temperature Coefficient of $(NdHoGd)_2Fe_{14}B$ Alloys
W % $Ho_2Fe_{14}B$+ X % $Nd_2Fe_{14}B$+ Y % $Gd_2Fe_{14}B$

| COMPOSITION | | | M(25C) | M(25C) | ALPHA | |
|---|---|---|---|---|---|---|
| W | X | Y | MB/FU | GAUSS | −50–200 | R SQUARE |
| 96 | 4 | 0 | 16.36 | 7364 | .006 | .024 |
| 86 | 4 | 10 | 16.45 | 7403 | −.002 | .002 |
| 76 | 4 | 20 | 16.54 | 7443 | −.009 | .064 |
| 66 | 4 | 30 | 16.63 | 7482 | −.015 | .196 |
| 56 | 4 | 40 | 16.71 | 7521 | −.022 | .356 |
| 46 | 4 | 50 | 16.80 | 7561 | −.029 | .507 |
| 36 | 4 | 60 | 16.89 | 7600 | −.035 | .630 |
| 26 | 4 | 70 | 16.98 | 7640 | −.041 | .723 |
| 16 | 4 | 80 | 17.07 | 7679 | −.047 | .793 |
| 6 | 4 | 90 | 17.15 | 7719 | −.053 | .843 |
| 94 | 6 | 0 | 16.70 | 7516 | .001 | .001 |
| 84 | 6 | 10 | 16.79 | 7555 | −.006 | .030 |
| 74 | 6 | 20 | 16.88 | 7595 | −.013 | .137 |
| 64 | 6 | 30 | 16.96 | 7634 | −.019 | .288 |
| 54 | 6 | 40 | 17.05 | 7674 | −.026 | .442 |
| 44 | 6 | 50 | 17.14 | 7713 | −.032 | .576 |
| 34 | 6 | 60 | 17.23 | 7753 | −.038 | .681 |
| 24 | 6 | 70 | 17.32 | 7792 | −.045 | .760 |
| 14 | 6 | 80 | 17.40 | 7832 | −.050 | .819 |
| 4 | 6 | 90 | 17.49 | 7871 | −.056 | .861 |
| 92 | 8 | 0 | 17.04 | 7668 | −.003 | .010 |
| 82 | 8 | 10 | 17.13 | 7707 | −.010 | .087 |
| 72 | 8 | 20 | 17.22 | 7747 | −.017 | .222 |
| 62 | 8 | 30 | 17.30 | 7786 | −.023 | .376 |
| 52 | 8 | 40 | 17.39 | 7826 | −.030 | .518 |
| 42 | 8 | 50 | 17.48 | 7865 | −.036 | .634 |
| 32 | 8 | 60 | 17.57 | 7905 | −.042 | .724 |
| 22 | 8 | 70 | 17.65 | 7944 | −.048 | .791 |
| 12 | 8 | 80 | 17.74 | 7984 | −.053 | .840 |
| 2 | 8 | 90 | 17.83 | 8023 | −.059 | .877 |
| 90 | 10 | 0 | 17.38 | 7820 | −.008 | .049 |
| 80 | 10 | 10 | 17.47 | 7860 | −.014 | .163 |
| 70 | 10 | 20 | 17.55 | 7899 | −.021 | .310 |
| 60 | 10 | 30 | 17.64 | 7939 | −.027 | .457 |
| 50 | 10 | 40 | 17.73 | 7978 | −.033 | .583 |
| 40 | 10 | 50 | 17.82 | 8018 | −.039 | .683 |
| 30 | 10 | 60 | 17.90 | 8057 | −.045 | .759 |
| 20 | 10 | 70 | 17.99 | 8096 | −.051 | .816 |
| 10 | 10 | 80 | 18.08 | 8136 | −.056 | .858 |
| 0 | 10 | 90 | 18.17 | 8175 | −.062 | .890 |
| 88 | 12 | 0 | 17.72 | 7972 | −.012 | .111 |
| 78 | 12 | 10 | 17.80 | 8012 | −.018 | .247 |
| 68 | 12 | 20 | 17.89 | 8051 | −.024 | .394 |
| 58 | 12 | 30 | 17.98 | 8091 | −.030 | .528 |
| 48 | 12 | 40 | 18.07 | 8130 | −.036 | .638 |
| 38 | 12 | 50 | 18.16 | 8170 | −.042 | .724 |
| 28 | 12 | 60 | 18.24 | 8209 | −.048 | .788 |
| 18 | 12 | 70 | 18.33 | 8249 | −.053 | .837 |
| 8 | 12 | 80 | 18.42 | 8288 | −.059 | .873 |
| 86 | 14 | 0 | 18.05 | 8125 | −.016 | .187 |
| 76 | 14 | 10 | 18.14 | 8164 | −.022 | .331 |
| 66 | 14 | 20 | 18.23 | 8204 | −.028 | .470 |
| 56 | 14 | 30 | 18.32 | 8243 | −.034 | .589 |
| 46 | 14 | 40 | 18.41 | 8283 | −.040 | .684 |
| 36 | 14 | 50 | 18.49 | 8322 | −.045 | .758 |
| 26 | 14 | 60 | 18.58 | 8361 | −.051 | .813 |
| 16 | 14 | 70 | 18.67 | 8401 | −.056 | .855 |
| 6 | 14 | 80 | 18.76 | 8440 | −.062 | .886 |
| 84 | 16 | 0 | 18.39 | 8277 | −.019 | .269 |
| 74 | 16 | 10 | 18.48 | 8316 | −.025 | .410 |
| 64 | 16 | 20 | 18.57 | 8356 | −.031 | .537 |
| 54 | 16 | 30 | 18.66 | 8395 | −.037 | .641 |
| 44 | 16 | 40 | 18.74 | 8435 | −.043 | .723 |
| 34 | 16 | 50 | 18.83 | 8474 | −.048 | .786 |
| 24 | 16 | 60 | 18.92 | 8514 | −.054 | .834 |
| 14 | 16 | 70 | 19.01 | 8553 | −.059 | .870 |
| 4 | 16 | 80 | 19.09 | 8593 | −.064 | .897 |
| 82 | 18 | 0 | 18.73 | 8429 | −.023 | .349 |
| 72 | 18 | 10 | 18.82 | 8469 | −.029 | .481 |
| 62 | 18 | 20 | 18.91 | 8508 | −.034 | .594 |
| 52 | 18 | 30 | 18.99 | 8547 | −.040 | .685 |

TABLE XVI-continued

Magnetization and Temperature Coefficient of $(NdHoGd)_2Fe_{14}B$ Alloys
W % $Ho_2Fe_{14}B$+ X % $Nd_2Fe_{14}B$+ Y % $Gd_2Fe_{14}B$

| COMPOSITION | | | M(25C) | M(25C) | ALPHA | |
|---|---|---|---|---|---|---|
| W | X | Y | MB/FU | GAUSS | −50–200 | R SQUARE |
| 42 | 18 | 40 | 19.08 | 8587 | −.045 | .756 |
| 32 | 18 | 50 | 19.17 | 8626 | −.051 | .810 |
| 22 | 18 | 60 | 19.26 | 8666 | −.056 | .851 |
| 12 | 18 | 70 | 19.35 | 8705 | −.061 | .883 |
| 2 | 18 | 80 | 19.43 | 8745 | −.066 | .907 |
| 80 | 20 | 0 | 19.07 | 8581 | −.026 | .424 |
| 70 | 20 | 10 | 19.16 | 8621 | −.032 | .544 |
| 60 | 20 | 20 | 19.25 | 8660 | −.037 | .644 |
| 50 | 20 | 30 | 19.33 | 8700 | −.043 | .723 |
| 40 | 20 | 40 | 19.42 | 8739 | −.048 | .784 |
| 30 | 20 | 50 | 19.51 | 8779 | −.054 | .830 |
| 20 | 20 | 60 | 19.60 | 8818 | −.059 | .866 |
| 10 | 20 | 70 | 19.68 | 8858 | −.064 | .894 |
| 0 | 20 | 80 | 19.77 | 8897 | −.069 | .915 |

Table XVI shows that the desired combination of properties may be achieved with 7 to 11% Nd, 82 to 90 % Ho, and 0 to 10% Gd.

It was further determined experimentally that the desired range of rare earth elements may be increased while achieving the desired combination of properties if three heavy rare earth elements are used in combination with Nd.

TABLE XVII

Magnetization and Temperature Coefficient of $(NdTbGdHo)_2Fe_{14}B$ Alloys
W % $Tb_2Fe_{14}B$+ X % $Nd_2Fe_{14}B$+ Y % $Ho_2Fe_{14}B$ Z % $HoFe_{14}B$

| COMPOSITION | | | | M(25C) | M(25C) | ALPHA | |
|---|---|---|---|---|---|---|---|
| W | X | Y | Z | MB/FU | GAUSS | −50–200 | R SQUARE |
| 38 | 2 | 0 | 60 | 15.11 | 6798 | .002 | .007 |
| 28 | 2 | 0 | 70 | 15.35 | 6907 | .005 | .022 |
| 18 | 2 | 0 | 80 | 15.59 | 7016 | .007 | .040 |
| 8 | 2 | 0 | 90 | 15.83 | 7124 | .009 | .059 |
| 34 | 2 | 4 | 60 | 15.24 | 6857 | .000 | .000 |
| 24 | 2 | 4 | 70 | 15.48 | 6966 | .002 | .006 |
| 14 | 2 | 4 | 80 | 15.72 | 7075 | .005 | .019 |
| 4 | 2 | 4 | 90 | 15.96 | 7184 | .007 | .035 |
| 30 | 2 | 8 | 60 | 15.37 | 6917 | −.002 | .004 |
| 20 | 2 | 8 | 70 | 15.61 | 7025 | .000 | .000 |
| 10 | 2 | 8 | 80 | 15.85 | 7134 | .002 | .005 |
| 0 | 2 | 8 | 90 | 16.10 | 7243 | .005 | .016 |
| 26 | 2 | 12 | 60 | 15.50 | 6976 | −.004 | .018 |
| 16 | 2 | 12 | 70 | 15.74 | 7085 | −.002 | .003 |
| 6 | 2 | 12 | 80 | 15.99 | 7193 | .000 | .000 |
| 22 | 2 | 16 | 60 | 15.63 | 7035 | −.006 | .039 |
| 12 | 2 | 16 | 70 | 15.88 | 7144 | −.004 | .014 |
| 2 | 2 | 16 | 80 | 16.12 | 7253 | −.002 | .003 |
| 18 | 2 | 20 | 60 | 15.77 | 7095 | −.008 | .068 |
| 8 | 2 | 20 | 70 | 16.01 | 7203 | −.006 | .033 |
| 36 | 4 | 0 | 60 | 15.49 | 6972 | −.002 | .005 |
| 26 | 4 | 0 | 70 | 15.74 | 7081 | .000 | .000 |
| 16 | 4 | 0 | 80 | 15.98 | 7190 | .002 | .005 |
| 6 | 4 | 0 | 90 | 16.22 | 7298 | .004 | .016 |
| 32 | 4 | 4 | 60 | 15.63 | 7031 | −.004 | .019 |
| 22 | 4 | 4 | 70 | 15.87 | 7140 | −.002 | .004 |
| 12 | 4 | 4 | 80 | 16.11 | 7249 | .000 | .000 |
| 2 | 4 | 4 | 90 | 16.35 | 7358 | .002 | .004 |
| 28 | 4 | 8 | 60 | 15.76 | 7091 | −.006 | .042 |
| 18 | 4 | 8 | 70 | 16.00 | 7199 | −.004 | .016 |
| 8 | 4 | 8 | 80 | 16.24 | 7308 | −.002 | .003 |
| 24 | 4 | 12 | 60 | 15.89 | 7150 | −.008 | .071 |
| 14 | 4 | 12 | 70 | 16.13 | 7259 | −.006 | .035 |
| 4 | 4 | 12 | 80 | 16.37 | 7367 | −.004 | .013 |
| 20 | 4 | 16 | 60 | 16.02 | 7209 | −.010 | .014 |
| 16 | 4 | 20 | 60 | 16.15 | 7268 | −.012 | .141 |
| 6 | 4 | 20 | 70 | 16.39 | 7377 | −.010 | .088 |
| 34 | 6 | 0 | 60 | 15.88 | 7146 | −.006 | .044 |
| 24 | 6 | 0 | 70 | 16.12 | 7255 | −.004 | .017 |
| 14 | 6 | 0 | 80 | 16.36 | 7364 | −.002 | .003 |
| 4 | 6 | 0 | 90 | 16.61 | 7472 | .000 | .000 |
| 30 | 6 | 4 | 60 | 16.01 | 7205 | −.008 | .074 |

TABLE XVII-continued

Magnetization and Temperature Coefficient of $(NdTbGdHo)_2 Fe_{14}B$ Alloys

W % $Tb_2Fe_{14}B$+ X % $Nd_2Fe_{14}B$+ Y % $Ho_2Fe_{14}B$ Z % $HoFe_{14}B$

| COMPOSITION | | | | M(25C) | M(25C) | ALPHA | |
|---|---|---|---|---|---|---|---|
| W | X | Y | Z | MB/FU | GAUSS | −50–200 | R SQUARE |
| 20 | 6 | 4 | 70 | 16.25 | 7314 | −.006 | .036 |
| 10 | 6 | 4 | 80 | 16.50 | 7423 | −.004 | .014 |
| 0 | 6 | 4 | 90 | 16.74 | 7532 | −.002 | .003 |
| 26 | 6 | 8 | 60 | 16.14 | 7265 | −.010 | .109 |
| 16 | 6 | 8 | 70 | 16.39 | 7373 | −.008 | .062 |
| 6 | 6 | 8 | 80 | 16.63 | 7482 | −.006 | .031 |
| 22 | 6 | 12 | 60 | 16.28 | 7324 | −.012 | .146 |
| 12 | 6 | 12 | 70 | 16.52 | 7433 | −.010 | .092 |
| 2 | 6 | 12 | 80 | 16.76 | 7541 | −.008 | .052 |
| 18 | 6 | 16 | 60 | 16.41 | 7383 | −.014 | .185 |
| 8 | 6 | 16 | 70 | 16.65 | 7492 | −.012 | .125 |
| 14 | 6 | 20 | 60 | 16.54 | 7442 | −.016 | .223 |
| 4 | 6 | 20 | 70 | 16.78 | 7551 | −.014 | .159 |
| 32 | 8 | 0 | 60 | 16.27 | 7320 | −.010 | .113 |
| 22 | 8 | 0 | 70 | 16.51 | 7429 | −.008 | .065 |
| 12 | 8 | 0 | 80 | 16.75 | 7538 | −.006 | .032 |
| 2 | 8 | 0 | 90 | 16.99 | 7646 | −.004 | .012 |
| 28 | 8 | 4 | 60 | 16.40 | 7379 | −.012 | .151 |
| 18 | 8 | 4 | 70 | 16.64 | 7488 | −.010 | .095 |
| 8 | 8 | 4 | 80 | 16.88 | 7597 | −.008 | .055 |
| 24 | 8 | 8 | 60 | 16.53 | 7439 | −.014 | .190 |
| 14 | 8 | 8 | 70 | 16.77 | 7547 | −.012 | .129 |
| 4 | 8 | 8 | 80 | 17.01 | 7656 | −.010 | .081 |
| 20 | 8 | 12 | 60 | 16.66 | 7498 | −.016 | .230 |
| 10 | 8 | 12 | 70 | 16.90 | 7607 | −.014 | .164 |
| 0 | 8 | 12 | 80 | 17.15 | 7715 | −.011 | .111 |
| 16 | 8 | 16 | 60 | 16.79 | 7557 | −.018 | .268 |
| 6 | 8 | 16 | 70 | 17.04 | 7666 | −.015 | .200 |
| 12 | 8 | 20 | 60 | 16.93 | 7616 | −.019 | .306 |
| 2 | 8 | 20 | 70 | 17.17 | 7725 | −.017 | .235 |
| 30 | 10 | 0 | 60 | 16.65 | 7494 | −.014 | .196 |
| 20 | 10 | 0 | 70 | 16.89 | 7603 | −.012 | .133 |
| 10 | 10 | 0 | 80 | 17.14 | 7711 | −.010 | .084 |
| 26 | 10 | 4 | 60 | 16.78 | 7553 | −.016 | .236 |
| 16 | 10 | 4 | 70 | 17.03 | 7662 | −.014 | .169 |
| 6 | 10 | 4 | 80 | 17.27 | 7771 | −.012 | .114 |
| 22 | 10 | 8 | 60 | 16.92 | 7613 | −.018 | .275 |
| 12 | 10 | 8 | 70 | 17.16 | 7721 | −.015 | .205 |
| 2 | 10 | 8 | 80 | 17.40 | 7830 | −.013 | .146 |
| 18 | 10 | 12 | 60 | 17.05 | 7672 | −.019 | .313 |
| 8 | 10 | 12 | 70 | 17.29 | 7781 | −.017 | .241 |
| 14 | 10 | 16 | 60 | 17.18 | 7731 | −.021 | .348 |
| 4 | 10 | 16 | 70 | 17.42 | 7840 | −.019 | .276 |
| 10 | 10 | 20 | 60 | 17.31 | 7790 | −.023 | .382 |
| 0 | 10 | 20 | 70 | 17.55 | 7899 | −.021 | .310 |
| 28 | 12 | 0 | 60 | 17.04 | 7668 | −.018 | .282 |
| 18 | 12 | 0 | 70 | 17.28 | 7777 | −.015 | .211 |
| 8 | 12 | 0 | 80 | 17.52 | 7885 | −.013 | .151 |
| 24 | 12 | 4 | 60 | 17.17 | 7727 | −.019 | .320 |
| 14 | 12 | 4 | 70 | 17.41 | 7836 | −.017 | .247 |
| 4 | 12 | 4 | 80 | 17.65 | 7945 | −.015 | .184 |
| 20 | 12 | 8 | 60 | 17.30 | 7786 | −.021 | .355 |
| 10 | 12 | 8 | 70 | 17.55 | 7895 | −.019 | .282 |
| 0 | 12 | 8 | 80 | 17.79 | 8004 | −.017 | .217 |
| 16 | 12 | 12 | 60 | 17.44 | 7846 | −.023 | .389 |
| 6 | 12 | 12 | 70 | 17.68 | 7955 | −.021 | .317 |
| 12 | 12 | 16 | 60 | 17.57 | 7905 | −.024 | .421 |
| 2 | 12 | 16 | 70 | 17.81 | 8014 | −.022 | .349 |
| 8 | 12 | 20 | 60 | 17.70 | 7964 | −.026 | .450 |

It was further determined experimentally that the desired range of rare earth elements may be increased while achieving the desired combination of properties if three heavy rare earth elements are used in combination with Nd.

In Table XVII Nd is combined with Tb, Gd and Ho. Specifically, the data show that if Nd varies from 1 to 10%, Tb 0 to 10%, and Gd 0 to 4% with Ho within the range of 80 to 90% the desired combination of properties is achieved.

TABLE XIX

Magnetization and Temperature Coefficient of $(NdErDyHo)_2 Fe_{14}B$ Alloys

W % $Er_2Fe_{14}B$+ X % $Nd_2Fe_{14}B$+ Y % $Dy_2Fe_{14}B$ Z % $HoFe_{14}B$

| COMPOSITION | | | | M(25C) | M(25C) | ALPHA | R |
|---|---|---|---|---|---|---|---|
| W | X | Y | Z | MB/FU | GAUSS | −50–200 | SQUARE |
| 38 | 2 | 0 | 60 | 16.73 | 7528 | −.013 | .065 |
| 28 | 2 | 0 | 70 | 16.54 | 7444 | −.007 | .023 |
| 18 | 2 | 0 | 80 | 16.36 | 7361 | −.001 | .001 |
| 8 | 2 | 0 | 90 | 16.17 | 7278 | .005 | .018 |
| 34 | 2 | 4 | 60 | 16.56 | 7451 | −.011 | .049 |
| 24 | 2 | 4 | 70 | 16.37 | 7368 | −.005 | .011 |
| 14 | 2 | 4 | 80 | 16.19 | 7284 | .001 | .001 |
| 4 | 2 | 4 | 90 | 16.00 | 7201 | .008 | .041 |
| 30 | 2 | 8 | 60 | 16.39 | 7374 | −.009 | .033 |
| 20 | 2 | 8 | 70 | 16.20 | 7291 | −.002 | .003 |
| 10 | 2 | 8 | 80 | 16.02 | 7208 | .004 | .010 |
| 0 | 2 | 8 | 90 | 15.83 | 7124 | .010 | .077 |
| 26 | 2 | 12 | 60 | 16.22 | 7297 | −.006 | .020 |
| 16 | 2 | 12 | 70 | 16.03 | 7214 | −.000 | .000 |
| 6 | 2 | 12 | 80 | 15.85 | 7131 | .006 | .028 |
| 22 | 2 | 16 | 60 | 16.05 | 7220 | −.004 | .008 |
| 12 | 2 | 16 | 70 | 15.86 | 7137 | .002 | .004 |
| 2 | 2 | 16 | 80 | 15.68 | 7054 | .009 | .059 |
| 18 | 2 | 20 | 60 | 15.87 | 7144 | −.002 | .001 |
| 8 | 2 | 20 | 70 | 15.69 | 7060 | .005 | .017 |
| 36 | 4 | 0 | 60 | 17.03 | 7663 | −.016 | .101 |
| 26 | 4 | 0 | 70 | 16.84 | 7580 | −.010 | .050 |
| 16 | 4 | 0 | 80 | 16.66 | 7497 | −.004 | .010 |
| 6 | 4 | 0 | 90 | 16.47 | 7414 | .002 | .002 |
| 32 | 4 | 4 | 60 | 16.86 | 7586 | −.014 | .083 |
| 22 | 4 | 4 | 70 | 16.67 | 7503 | −.008 | .033 |
| 12 | 4 | 4 | 80 | 16.49 | 7420 | −.002 | .002 |
| 2 | 4 | 4 | 90 | 16.30 | 7337 | .004 | .014 |
| 28 | 4 | 8 | 60 | 16.69 | 7510 | −.012 | .064 |
| 18 | 4 | 8 | 70 | 16.50 | 7426 | −.006 | .019 |
| 8 | 4 | 8 | 80 | 16.32 | 7343 | .000 | .000 |
| 24 | 4 | 12 | 60 | 16.52 | 7433 | −.009 | .046 |
| 14 | 4 | 12 | 70 | 16.33 | 7350 | −.003 | .007 |
| 4 | 4 | 12 | 80 | 16.15 | 7266 | .003 | .006 |
| 20 | 4 | 16 | 60 | 16.35 | 7356 | −.007 | .029 |
| 10 | 4 | 16 | 70 | 16.16 | 7273 | −.001 | .001 |
| 0 | 4 | 16 | 80 | 15.98 | 7190 | .005 | .024 |
| 16 | 4 | 20 | 60 | 16.18 | 7279 | −.005 | .015 |
| 6 | 4 | 20 | 70 | 15.99 | 7196 | .001 | .002 |
| 34 | 6 | 0 | 60 | 17.33 | 7799 | −.019 | .143 |
| 24 | 6 | 0 | 70 | 17.15 | 7715 | −.013 | .086 |
| 14 | 6 | 0 | 80 | 16.96 | 7632 | −.007 | .033 |
| 4 | 6 | 0 | 90 | 16.78 | 7549 | −.001 | .002 |
| 30 | 6 | 4 | 60 | 17.16 | 7722 | −.017 | .124 |
| 20 | 6 | 4 | 70 | 16.97 | 7639 | −.011 | .066 |
| 10 | 6 | 4 | 80 | 16.79 | 7556 | −.005 | .018 |
| 0 | 6 | 4 | 90 | 16.61 | 7472 | .001 | .001 |
| 26 | 6 | 8 | 60 | 16.99 | 7645 | −.015 | .104 |
| 16 | 6 | 8 | 70 | 16.80 | 7562 | −.009 | .047 |
| 6 | 6 | 8 | 80 | 16.62 | 7479 | −.003 | .006 |
| 2 | 6 | 12 | 60 | 16.82 | 7568 | −.012 | .084 |
| 12 | 6 | 12 | 70 | 16.63 | 7485 | −.007 | .029 |
| 2 | 6 | 12 | 80 | 16.45 | 7402 | −.001 | .000 |
| 18 | 6 | 16 | 60 | 16.65 | 7492 | −.010 | .063 |
| 8 | 6 | 16 | 70 | 16.46 | 7408 | −.004 | .014 |
| 14 | 6 | 20 | 60 | 16.48 | 7415 | −.008 | .043 |
| 4 | 6 | 20 | 70 | 16.29 | 7332 | −.002 | .003 |
| 32 | 8 | 0 | 60 | 17.63 | 7934 | −.021 | .190 |
| 22 | 8 | 0 | 70 | 17.45 | 7851 | −.016 | .130 |
| 12 | 8 | 0 | 80 | 17.26 | 7768 | −.010 | .069 |
| 2 | 8 | 0 | 90 | 17.08 | 7685 | −.005 | .017 |
| 28 | 8 | 4 | 60 | 17.46 | 7857 | −.019 | .171 |
| 18 | 8 | 4 | 70 | 17.28 | 7774 | −.014 | .109 |
| 8 | 8 | 4 | 80 | 17.09 | 7691 | −.008 | .048 |
| 24 | 8 | 8 | 60 | 17.29 | 7781 | −.017 | .152 |
| 14 | 8 | 8 | 70 | 17.11 | 7697 | −.012 | .088 |
| 4 | 8 | 8 | 80 | 16.92 | 7614 | −.006 | .029 |
| 20 | 8 | 12 | 60 | 17.12 | 7704 | −.015 | .131 |
| 10 | 8 | 12 | 70 | 16.93 | 7621 | −.010 | .065 |
| 0 | 8 | 12 | 80 | 16.75 | 7538 | −.004 | .013 |
| 16 | 8 | 16 | 60 | 16.95 | 7627 | −.013 | .108 |
| 6 | 8 | 16 | 70 | 16.76 | 7544 | −.007 | .044 |
| 12 | 8 | 20 | 60 | 16.78 | 7550 | −.011 | .085 |
| 2 | 8 | 20 | 70 | 16.59 | 7467 | −.005 | .024 |
| 30 | 10 | 0 | 60 | 17.93 | 8070 | −.024 | .240 |

TABLE XIX-continued

Magnetization and Temperature Coefficient of $(NdErDyHo)_2 Fe_{14}B$ Alloys
W % $Er_2Fe_{14}B$+ X % $Nd_2Fe_{14}B$+ Y % $Dy_2Fe_{14}B$ Z % $HoFe_{14}B$

| COMPOSITION | | | | M(25C) | M(25C) | ALPHA | R |
|---|---|---|---|---|---|---|---|
| W | X | Y | Z | MB/FU | GAUSS | −50–200 | SQUARE |
| 20 | 10 | 0 | 70 | 17.75 | 7987 | −.019 | .181 |
| 10 | 10 | 0 | 80 | 17.56 | 7903 | −.013 | .115 |
| 0 | 10 | 0 | 90 | 17.38 | 7820 | −.008 | .049 |
| 26 | 10 | 4 | 60 | 17.76 | 7993 | −.022 | .223 |
| 16 | 10 | 4 | 70 | 17.58 | 7910 | −.017 | .160 |
| 6 | 10 | 4 | 80 | 17.39 | 7827 | −.011 | .092 |
| 22 | 10 | 8 | 60 | 17.59 | 7916 | −.020 | .205 |
| 12 | 10 | 8 | 70 | 17.41 | 7833 | −.015 | .138 |
| 2 | 10 | 8 | 80 | 17.22 | 7750 | −.009 | .068 |
| 18 | 10 | 12 | 60 | 17.42 | 7839 | −.018 | .184 |
| 8 | 10 | 12 | 70 | 17.24 | 7756 | −.013 | .114 |
| 14 | 10 | 16 | 60 | 17.25 | 7763 | −.016 | .163 |
| 4 | 10 | 16 | 70 | 17.07 | 7679 | −.010 | .089 |
| 10 | 10 | 20 | 60 | 17.08 | 7686 | −.014 | .139 |
| 0 | 10 | 20 | 70 | 16.89 | 7603 | −.008 | .064 |
| 28 | 12 | 0 | 60 | 18.23 | 8205 | −.026 | .292 |
| 18 | 12 | 0 | 70 | 18.05 | 8122 | −.021 | .236 |
| 8 | 12 | 0 | 80 | 17.86 | 8039 | −.016 | .170 |
| 24 | 12 | 4 | 60 | 18.06 | 8129 | −.025 | .277 |
| 14 | 12 | 4 | 70 | 17.88 | 8045 | −.019 | .217 |
| 4 | 12 | 4 | 80 | 17.69 | 7962 | −.014 | .146 |
| 20 | 12 | 8 | 60 | 17.89 | 8052 | −.023 | .261 |
| 10 | 12 | 8 | 70 | 17.71 | 7969 | −.017 | .196 |
| 0 | 12 | 8 | 80 | 17.52 | 7885 | −.012 | .121 |
| 16 | 12 | 12 | 60 | 17.72 | 7975 | −.021 | .243 |
| 6 | 12 | 12 | 70 | 17.54 | 7892 | −.015 | .173 |
| 12 | 12 | 16 | 60 | 17.55 | 7898 | −.019 | .223 |
| 2 | 12 | 16 | 70 | 17.37 | 7815 | −.013 | .148 |
| 8 | 12 | 20 | 60 | 17.38 | 7821 | −.017 | .201 |

TABLE XXI

Magnetization and Temperature Coefficient of $(NdErTmHo)_2 Fe_{14}B$ Alloys
W % $Er_2Fe_{14}B$+ X % $Nd_2Fe_{14}B$+ Y % $Tm_2Fe_{14}B$ Z % $HoFe_{14}B$

| COMPOSITION | | | | M(25C) | M(25C) | ALPHA | R |
|---|---|---|---|---|---|---|---|
| W | X | Y | Z | MB/FU | GAUSS | −50–200 | SQUARE |
| 38 | 2 | 0 | 60 | 16.73 | 7528 | −.013 | .065 |
| 28 | 2 | 0 | 70 | 16.54 | 7444 | −.007 | .023 |
| 18 | 2 | 0 | 80 | 16.36 | 7361 | −.001 | .001 |
| 8 | 2 | 0 | 90 | 16.17 | 7278 | .005 | .018 |
| 34 | 2 | 4 | 60 | 16.90 | 7604 | −.015 | .088 |
| 24 | 2 | 4 | 70 | 16.71 | 7521 | −.010 | .041 |
| 14 | 2 | 4 | 80 | 16.53 | 7438 | −.004 | .007 |
| 4 | 2 | 4 | 90 | 16.34 | 7355 | .003 | .004 |
| 30 | 2 | 8 | 60 | 17.07 | 7681 | −.018 | .113 |
| 20 | 2 | 8 | 70 | 16.88 | 7598 | −.012 | .062 |
| 10 | 2 | 8 | 80 | 16.70 | 7515 | −.006 | .019 |
| 0 | 2 | 8 | 90 | 16.51 | 7431 | .000 | .000 |
| 26 | 2 | 12 | 60 | 17.24 | 7758 | −.020 | .138 |
| 16 | 2 | 12 | 70 | 17.05 | 7675 | −.014 | .086 |
| 6 | 2 | 12 | 80 | 16.37 | 7591 | −.008 | .037 |
| 22 | 2 | 16 | 60 | 17.41 | 7835 | −.022 | .165 |
| 12 | 2 | 16 | 70 | 17.23 | 7751 | −.016 | .112 |
| 2 | 2 | 16 | 80 | 17.04 | 7668 | −.011 | .059 |
| 18 | 2 | 20 | 60 | 17.58 | 7911 | −.024 | .191 |
| 8 | 2 | 20 | 70 | 17.40 | 7828 | −.019 | .139 |
| 36 | 4 | 0 | 60 | 17.03 | 7663 | −.016 | .101 |
| 26 | 4 | 0 | 70 | 16.84 | 7580 | −.010 | .050 |
| 16 | 4 | 0 | 80 | 16.66 | 7497 | −.004 | .010 |
| 6 | 4 | 0 | 90 | 16.47 | 7414 | .002 | .002 |
| 32 | 4 | 4 | 60 | 17.20 | 7740 | −.018 | .127 |
| 22 | 4 | 4 | 70 | 17.01 | 7657 | −.012 | .073 |
| 12 | 4 | 4 | 80 | 16.83 | 7573 | −.007 | .026 |
| 2 | 4 | 4 | 90 | 16.65 | 7490 | −.001 | .000 |
| 28 | 4 | 8 | 60 | 17.37 | 7817 | −.020 | .154 |
| 18 | 4 | 8 | 70 | 17.19 | 7733 | −.015 | .099 |
| 8 | 4 | 8 | 80 | 17.00 | 7650 | −.009 | .046 |
| 24 | 4 | 12 | 60 | 17.54 | 7893 | −.022 | .181 |
| 14 | 4 | 12 | 70 | 17.36 | 7810 | −.017 | .127 |
| 4 | 4 | 12 | 80 | 17.17 | 7727 | −.011 | .070 |
| 20 | 4 | 16 | 60 | 17.71 | 7970 | −.025 | .209 |

TABLE XXI-continued

Magnetization and Temperature Coefficient of $(NdErTmHo)_2 Fe_{14}B$ Alloys
W % $Er_2Fe_{14}B$+ X % $Nd_2Fe_{14}B$+ Y % $Tm_2Fe_{14}B$ Z % $HoFe_{14}B$

| COMPOSITION | | | | M(25C) | M(25C) | ALPHA | R |
|---|---|---|---|---|---|---|---|
| W | X | Y | Z | MB/FU | GAUSS | −50–200 | SQUARE |
| 10 | 4 | 16 | 70 | 17.53 | 7887 | −.019 | .155 |
| 0 | 4 | 16 | 80 | 17.34 | 7804 | −.014 | .097 |
| 16 | 4 | 20 | 60 | 17.88 | 8047 | −.027 | .236 |
| 6 | 4 | 20 | 70 | 17.70 | 7964 | −.021 | .184 |
| 34 | 6 | 0 | 60 | 17.33 | 7799 | −.019 | .143 |
| 24 | 6 | 0 | 70 | 17.15 | 7715 | −.013 | .086 |
| 14 | 6 | 0 | 80 | 16.96 | 7632 | −.007 | .033 |
| 4 | 6 | 0 | 90 | 16.78 | 7549 | −.001 | .002 |
| 30 | 6 | 4 | 60 | 17.50 | 7875 | −.021 | .171 |
| 20 | 6 | 4 | 70 | 17.32 | 7792 | −.015 | .114 |
| 10 | 6 | 4 | 80 | 17.13 | 7709 | −.010 | .056 |
| 0 | 6 | 4 | 90 | 16.95 | 7626 | −.004 | .011 |
| 26 | 6 | 8 | 60 | 17.67 | 7952 | −.023 | .200 |
| 16 | 6 | 8 | 70 | 17.49 | 7869 | −.018 | .143 |
| 6 | 6 | 8 | 80 | 17.30 | 7786 | −.012 | .083 |
| 22 | 6 | 12 | 60 | 17.84 | 8029 | −.025 | .228 |
| 12 | 6 | 12 | 70 | 17.66 | 7946 | −.020 | .173 |
| 2 | 6 | 12 | 80 | 17.47 | 7863 | −.014 | .113 |
| 18 | 6 | 16 | 60 | 18.01 | 8106 | −.027 | .255 |
| 8 | 6 | 16 | 70 | 17.83 | 8023 | −.022 | .203 |
| 14 | 6 | 20 | 60 | 18.18 | 8183 | −.029 | .282 |
| 4 | 6 | 20 | 70 | 18.00 | 8099 | −.024 | .233 |
| 32 | 8 | 0 | 60 | 17.63 | 7934 | −.021 | .190 |
| 22 | 8 | 0 | 70 | 17.45 | 7851 | −.016 | .130 |
| 12 | 8 | 0 | 80 | 17.26 | 7768 | −.010 | .069 |
| 2 | 8 | 0 | 90 | 17.08 | 7685 | −.005 | .017 |
| 28 | 8 | 4 | 60 | 17.80 | 8011 | −.023 | .219 |
| 18 | 8 | 4 | 70 | 17.62 | 7928 | −.018 | .161 |
| 8 | 8 | 4 | 80 | 17.43 | 7845 | −.013 | .098 |
| 24 | 8 | 8 | 60 | 17.97 | 8088 | −.026 | .248 |
| 14 | 8 | 8 | 70 | 17.79 | 8005 | −.020 | .193 |
| 4 | 8 | 8 | 80 | 17.60 | 7921 | −.015 | .130 |
| 20 | 8 | 12 | 60 | 18.14 | 8165 | −.028 | .276 |
| 10 | 8 | 12 | 70 | 17.96 | 8081 | −.022 | .224 |
| 0 | 8 | 12 | 80 | 17.77 | 7998 | −.017 | .163 |
| 16 | 8 | 16 | 60 | 18.31 | 8241 | −.029 | .303 |
| 6 | 8 | 16 | 70 | 18.13 | 8158 | −.024 | .254 |
| 12 | 8 | 20 | 60 | 18.48 | 8318 | −.031 | .329 |
| 2 | 8 | 20 | 70 | 18.30 | 8235 | −.026 | .284 |
| 30 | 10 | 0 | 60 | 17.93 | 8070 | −.024 | .240 |
| 20 | 10 | 0 | 70 | 17.75 | 7987 | −.019 | .181 |
| 10 | 10 | 0 | 80 | 17.56 | 7903 | −.013 | .115 |
| 0 | 10 | 0 | 90 | 17.38 | 7820 | −.008 | .049 |
| 26 | 10 | 4 | 60 | 18.10 | 8147 | −.026 | .269 |
| 16 | 10 | 4 | 70 | 17.92 | 8063 | −.021 | .214 |
| 6 | 10 | 4 | 80 | 17.73 | 7980 | −.015 | .149 |
| 22 | 10 | 8 | 60 | 18.27 | 8223 | −.028 | .298 |
| 12 | 10 | 8 | 70 | 18.09 | 8140 | −.023 | .246 |
| 2 | 10 | 8 | 80 | 17.90 | 8057 | −.018 | .184 |
| 18 | 10 | 12 | 60 | 18.44 | 8300 | −.030 | .325 |
| 8 | 10 | 12 | 70 | 18.26 | 8217 | −.025 | .277 |
| 14 | 10 | 16 | 60 | 18.62 | 8377 | −.032 | .351 |
| 4 | 10 | 16 | 70 | 18.43 | 8294 | −.027 | .307 |
| 10 | 10 | 20 | 60 | 18.79 | 8454 | −.034 | .376 |
| 0 | 10 | 20 | 70 | 18.60 | 8370 | −.029 | .335 |
| 28 | 12 | 0 | 60 | 18.23 | 8205 | −.026 | .292 |
| 18 | 12 | 0 | 70 | 18.05 | 8122 | −.021 | .236 |
| 8 | 12 | 0 | 80 | 17.86 | 8039 | −.016 | .170 |
| 24 | 12 | 4 | 60 | 18.40 | 8282 | −.028 | .321 |
| 14 | 12 | 4 | 79 | 18.22 | 8199 | −.023 | .269 |
| 4 | 12 | 4 | 80 | 18.04 | 8116 | −.018 | .207 |
| 20 | 12 | 8 | 60 | 18.58 | 8359 | −.030 | .348 |
| 10 | 12 | 8 | 70 | 18.39 | 8276 | −.025 | .301 |
| 0 | 12 | 8 | 80 | 18.21 | 8193 | −.020 | .243 |
| 16 | 12 | 12 | 60 | 18.75 | 8436 | −.032 | .374 |
| 6 | 12 | 12 | 70 | 18.56 | 8353 | −.027 | .331 |
| 12 | 12 | 16 | 60 | 18.92 | 8513 | −.034 | .399 |
| 2 | 12 | 16 | 70 | 18.73 | 8429 | −.029 | .359 |
| 8 | 12 | 20 | 60 | 19.09 | 8589 | −.036 | .422 |

Table XXI shows combinations of Nd with Er, Tm and Ho. The data shows that the desired combination of properties may be achieved if Nd varies from 3 to 11%, Tm from 0 to 12%, Er from 0 to 18%, and Ho from 76 to 92%.

TABLE XXIII

Magnetization and Temperature Coefficient of $(NdTbDyHo)_2 Fe_{14}B$ Alloys
W % $Tb_2Fe_{14}B$+ X % $Nd_2Fe_{14}B$+ Y % $Dy_2Fe_{14}B$ Z % $Ho_2Fe_{14}B$

| COMPOSITION | | | | M(25C) | M(25C) | ALPHA | R |
|---|---|---|---|---|---|---|---|
| W | X | Y | Z | MB/FU | GAUSS | −50–200 | SQUARE |
| 38 | 2 | 0 | 60 | 15.11 | 6798 | .002 | .007 |
| 28 | 2 | 0 | 70 | 15.35 | 6907 | .005 | .022 |
| 18 | 2 | 0 | 80 | 15.59 | 7016 | .007 | .040 |
| 8 | 2 | 0 | 90 | 15.83 | 7124 | .009 | .059 |
| 34 | 2 | 4 | 60 | 15.11 | 6798 | .003 | .012 |
| 24 | 2 | 4 | 70 | 15.35 | 6907 | .005 | .029 |
| 14 | 2 | 4 | 80 | 15.59 | 7016 | .008 | .048 |
| 4 | 2 | 4 | 90 | 15.83 | 7124 | .010 | .068 |
| 30 | 2 | 8 | 60 | 15.11 | 6798 | .004 | .018 |
| 20 | 2 | 8 | 70 | 15.35 | 6907 | .006 | .036 |
| 10 | 2 | 8 | 80 | 15.59 | 7016 | .008 | .057 |
| 0 | 2 | 8 | 90 | 15.83 | 7124 | .010 | .077 |
| 26 | 2 | 12 | 60 | 15.11 | 6798 | .005 | .025 |
| 16 | 2 | 12 | 70 | 15.35 | 6907 | .007 | .045 |
| 6 | 2 | 12 | 80 | 15.59 | 7016 | .009 | .065 |
| 22 | 2 | 16 | 60 | 15.11 | 6798 | .006 | .033 |
| 12 | 2 | 16 | 70 | 15.35 | 6907 | .008 | .053 |
| 2 | 2 | 16 | 80 | 15.59 | 7016 | .010 | .075 |
| 18 | 2 | 20 | 60 | 15.11 | 6798 | .006 | .041 |
| 8 | 2 | 20 | 70 | 15.35 | 6907 | .009 | .063 |
| 36 | 4 | 0 | 60 | 15.49 | 6972 | −.002 | .005 |
| 26 | 4 | 0 | 70 | 15.74 | 7081 | .000 | .000 |
| 16 | 4 | 0 | 80 | 15.98 | 7190 | .002 | .005 |
| 6 | 4 | 0 | 90 | 16.22 | 7298 | .004 | .016 |
| 32 | 4 | 4 | 60 | 15.49 | 6972 | −.001 | .002 |
| 22 | 4 | 4 | 70 | 15.74 | 7081 | .001 | .001 |
| 12 | 4 | 4 | 80 | 15.98 | 7190 | .003 | .009 |
| 2 | 4 | 4 | 90 | 16.22 | 7298 | .005 | .021 |
| 28 | 4 | 8 | 60 | 15.49 | 6972 | −.000 | .000 |
| 18 | 4 | 8 | 70 | 15.74 | 7081 | .002 | .003 |
| 8 | 4 | 8 | 80 | 15.98 | 7190 | .004 | .013 |
| 24 | 4 | 12 | 60 | 15.49 | 6972 | .000 | .000 |
| 14 | 4 | 12 | 70 | 15.74 | 7081 | .003 | .006 |
| 4 | 4 | 12 | 80 | 15.98 | 7190 | .005 | .018 |
| 20 | 4 | 16 | 60 | 15.49 | 6972 | .001 | .001 |
| 10 | 4 | 16 | 70 | 15.74 | 7081 | .003 | .010 |
| 0 | 4 | 16 | 80 | 15.98 | 7190 | .005 | .024 |
| 16 | 4 | 20 | 60 | 15.49 | 6972 | .002 | .004 |
| 6 | 4 | 20 | 70 | 15.74 | 7081 | .004 | .015 |
| 34 | 6 | 0 | 60 | 15.88 | 7146 | −.006 | .044 |
| 24 | 6 | 0 | 70 | 16.12 | 7255 | −.004 | .017 |
| 14 | 6 | 0 | 80 | 16.36 | 7364 | −.002 | .003 |
| 4 | 6 | 0 | 90 | 16.61 | 7472 | .000 | .000 |
| 30 | 6 | 4 | 60 | 15.88 | 7146 | −.005 | .034 |
| 20 | 6 | 4 | 70 | 16.12 | 7255 | −.003 | .011 |
| 10 | 6 | 4 | 80 | 16.36 | 7364 | −.001 | .001 |
| 0 | 6 | 4 | 90 | 16.61 | 7472 | .001 | .001 |
| 26 | 6 | 8 | 60 | 15.88 | 7146 | −.005 | .025 |
| 16 | 6 | 8 | 70 | 16.12 | 7255 | −.003 | .006 |
| 6 | 6 | 8 | 80 | 16.36 | 7364 | −.000 | .000 |
| 22 | 6 | 12 | 60 | 15.88 | 7146 | −.004 | .017 |
| 12 | 6 | 12 | 70 | 16.12 | 7255 | −.002 | .003 |
| 2 | 6 | 12 | 80 | 16.36 | 7364 | .000 | .000 |
| 18 | 6 | 16 | 60 | 15.88 | 7146 | −.003 | .011 |
| 8 | 6 | 16 | 70 | 16.12 | 7255 | −.001 | .001 |
| 14 | 6 | 20 | 60 | 15.88 | 7146 | −.002 | .006 |
| 4 | 6 | 20 | 70 | 16.12 | 7255 | −.000 | .000 |
| 32 | 8 | 0 | 60 | 16.27 | 7320 | −.000 | .113 |
| 22 | 8 | 0 | 70 | 16.51 | 7429 | −.008 | .065 |
| 12 | 8 | 0 | 80 | 16.75 | 7538 | −.006 | .032 |
| 2 | 8 | 0 | 90 | 16.99 | 7646 | −.004 | .012 |
| 28 | 8 | 4 | 60 | 16.27 | 7320 | −.009 | .097 |
| 18 | 8 | 4 | 70 | 16.51 | 7429 | −.007 | .053 |
| 8 | 8 | 4 | 80 | 16.75 | 7358 | −.005 | .025 |
| 24 | 8 | 8 | 60 | 16.27 | 7320 | −.009 | .082 |
| 14 | 8 | 8 | 70 | 16.51 | 7429 | −.007 | .043 |
| 4 | 8 | 8 | 80 | 16.75 | 7538 | −.004 | .018 |
| 20 | 8 | 12 | 60 | 16.27 | 7320 | −.008 | .068 |
| 10 | 8 | 12 | 70 | 16.51 | 7429 | −.006 | .033 |
| 0 | 8 | 12 | 80 | 16.75 | 7538 | −.004 | .013 |
| 16 | 8 | 16 | 60 | 16.27 | 7320 | −.007 | .056 |
| 6 | 8 | 16 | 70 | 16.51 | 7429 | −.005 | .025 |
| 12 | 8 | 20 | 60 | 16.27 | 7320 | −.007 | .044 |

TABLE XXIII-continued

Magnetization and Temperature Coefficient of $(NdTbDyHo)_2 Fe_{14}B$ Alloys
W % $Tb_2Fe_{14}B$+ X % $Nd_2Fe_{14}B$+ Y % $Dy_2Fe_{14}B$ Z % $Ho_2Fe_{14}B$

| COMPOSITION | | | | M(25C) | M(25C) | ALPHA | R |
|---|---|---|---|---|---|---|---|
| W | X | Y | Z | MB/FU | GAUSS | −50–200 | SQUARE |
| 2 | 8 | 20 | 70 | 16.51 | 7429 | −.004 | .018 |
| 30 | 10 | 0 | 60 | 16.65 | 7494 | −.014 | .196 |
| 20 | 10 | 0 | 70 | 16.89 | 7603 | −.012 | .133 |
| 10 | 10 | 0 | 80 | 17.14 | 7711 | −.010 | .084 |
| 0 | 10 | 0 | 90 | 17.38 | 7820 | −.008 | .049 |
| 26 | 10 | 4 | 60 | 16.65 | 7494 | −.013 | .177 |
| 16 | 10 | 4 | 70 | 16.89 | 7603 | −.011 | .117 |
| 6 | 10 | 4 | 80 | 17.14 | 7711 | −.009 | .072 |
| 22 | 10 | 8 | 60 | 16.65 | 7494 | −.013 | .158 |
| 12 | 10 | 8 | 70 | 16.89 | 7603 | −.010 | .102 |
| 2 | 10 | 8 | 80 | 17.14 | 7711 | −.008 | .061 |
| 18 | 10 | 12 | 60 | 16.65 | 7494 | −.012 | .140 |
| 8 | 10 | 12 | 70 | 16.89 | 7603 | −.010 | .088 |
| 14 | 10 | 16 | 60 | 16.65 | 7494 | −.011 | .123 |
| 4 | 10 | 16 | 70 | 16.89 | 7603 | −.009 | .075 |
| 10 | 10 | 20 | 60 | 16.65 | 7494 | −.010 | .108 |
| 0 | 10 | 20 | 70 | 16.89 | 7603 | −.008 | .064 |
| 28 | 12 | 0 | 60 | 17.04 | 7668 | −.018 | .282 |
| 18 | 12 | 0 | 70 | 17.28 | 7777 | −.015 | .211 |
| 8 | 12 | 0 | 80 | 17.52 | 7885 | −.013 | .151 |
| 24 | 12 | 4 | 60 | 17.04 | 7668 | −.017 | .261 |
| 14 | 12 | 4 | 70 | 17.28 | 7777 | −.015 | .192 |
| 4 | 12 | 4 | 80 | 17.52 | 7885 | −.013 | .135 |
| 20 | 12 | 8 | 60 | 17.04 | 7668 | −.016 | .241 |
| 10 | 12 | 8 | 70 | 17.28 | 7777 | −.014 | .175 |
| 0 | 12 | 8 | 80 | 17.52 | 7885 | −.012 | .121 |
| 16 | 12 | 12 | 60 | 17.04 | 7668 | −.015 | .221 |
| 6 | 12 | 12 | 70 | 17.28 | 7777 | −.013 | .158 |
| 12 | 12 | 16 | 60 | 17.04 | 7668 | −.015 | .202 |
| 2 | 12 | 16 | 70 | 17.28 | 7777 | −.013 | .142 |
| 8 | 12 | 20 | 60 | 17.04 | 7668 | −.014 | .184 |

Table XXIII shows alloys wherein the Nd is combined with Tb, Dy and Ho. The desired combination of properties is achieved if Nd varies from 9 to 11, Dy varies from 0 to 15, Tb from 0 to 12 and Ho is within the range from 75 to 88%.

TABLE XXV

Magnetization and Temperature Coefficient of $(NdGdDyHo)_2 Fe_{14}B$ Alloys
W % $Gd_2Fe_{14}B$+ X % $Nd_2Fe_{14}B$+ Y % $Dy_2Fe_{14}B$+ Z % $HoFe_{14}B$

| COMPOSITION | | | | M(25C) | M(25C) | ALPHA | R |
|---|---|---|---|---|---|---|---|
| W | X | Y | Z | MB/FU | GAUSS | −50–200 | SQUARE |
| 38 | 2 | 0 | 60 | 16.36 | 7361 | −.017 | .230 |
| 28 | 2 | 0 | 70 | 16.27 | 7322 | −.010 | .085 |
| 18 | 2 | 0 | 80 | 16.18 | 7282 | −.003 | .006 |
| 8 | 2 | 0 | 90 | 16.10 | 7243 | .005 | .016 |
| 34 | 2 | 4 | 60 | 16.23 | 7302 | −.014 | .174 |
| 24 | 2 | 4 | 70 | 16.14 | 7263 | −.007 | .046 |
| 14 | 2 | 4 | 80 | 16.05 | 7223 | .000 | .000 |
| 4 | 2 | 4 | 90 | 15.96 | 7184 | .007 | .042 |
| 30 | 2 | 8 | 60 | 16.10 | 7243 | −.012 | .121 |
| 20 | 2 | 8 | 70 | 16.01 | 7203 | −.004 | .018 |
| 10 | 2 | 8 | 80 | 15.92 | 7164 | .003 | .007 |
| 0 | 2 | 8 | 90 | 15.83 | 7124 | .010 | .077 |
| 26 | 2 | 12 | 60 | 15.96 | 7183 | −.009 | .074 |
| 16 | 2 | 12 | 70 | 15.88 | 7144 | −.002 | .002 |
| 6 | 2 | 12 | 80 | 15.79 | 7105 | .006 | .027 |
| 22 | 2 | 16 | 60 | 15.83 | 7124 | −.006 | .036 |
| 12 | 2 | 16 | 70 | 15.74 | 7085 | .001 | .001 |
| 2 | 2 | 16 | 80 | 15.66 | 7045 | .009 | .060 |
| 18 | 2 | 20 | 60 | 15.70 | 7065 | −.003 | .011 |
| 8 | 2 | 20 | 70 | 15.61 | 7025 | .004 | .015 |
| 36 | 4 | 0 | 60 | 16.68 | 7506 | −.019 | .292 |
| 26 | 4 | 0 | 70 | 16.59 | 7466 | −.013 | .137 |
| 16 | 4 | 0 | 80 | 16.50 | 7427 | −.006 | .029 |
| 6 | 4 | 0 | 90 | 16.42 | 7387 | .001 | .001 |
| 32 | 4 | 4 | 60 | 16.55 | 7446 | −.017 | .236 |
| 22 | 4 | 4 | 70 | 16.46 | 7407 | −.010 | .090 |
| 12 | 4 | 4 | 80 | 16.37 | 7367 | −.003 | .008 |

TABLE XXV-continued

Magnetization and Temperature Coefficient of $(NdGdDyHo)_2Fe_{14}B$ Alloys
W % $Gd_2Fe_{14}B$+ X % $Nd_2Fe_{14}B$+ Y % $Dy_2Fe_{14}B$+ Z % $HoFe_{14}B$

| COMPOSITION | | | | M(25C) | M(25C) | ALPHA | R |
|---|---|---|---|---|---|---|---|
| W | X | Y | Z | MB/FU | GAUSS | −50-200 | SQUARE |
| 2 | 4 | 4 | 90 | 16.28 | 7328 | .004 | .013 |
| 28 | 4 | 8 | 60 | 16.42 | 7387 | −.014 | .180 |
| 18 | 4 | 8 | 70 | 16.33 | 7348 | −.007 | .050 |
| 8 | 4 | 8 | 80 | 16.24 | 7308 | −.000 | .000 |
| 24 | 4 | 12 | 60 | 16.28 | 7328 | −.012 | .127 |
| 14 | 4 | 12 | 70 | 16.20 | 7288 | −.005 | .021 |
| 4 | 4 | 12 | 80 | 16.11 | 7249 | .002 | .005 |
| 20 | 4 | 16 | 60 | 16.15 | 7268 | −.009 | .079 |
| 10 | 4 | 16 | 70 | 16.06 | 7229 | −.002 | .004 |
| 0 | 4 | 16 | 80 | 15.98 | 7190 | .005 | .024 |
| 16 | 4 | 20 | 60 | 16.02 | 7209 | −.006 | .040 |
| 6 | 4 | 20 | 70 | 15.93 | 7170 | .001 | .001 |
| 34 | 6 | 0 | 60 | 17.00 | 7650 | −.022 | .351 |
| 24 | 6 | 0 | 70 | 16.91 | 7611 | −.015 | .194 |
| 14 | 6 | 0 | 80 | 16.82 | 7571 | −.009 | .065 |
| 4 | 6 | 0 | 90 | 16.74 | 7532 | −.002 | .003 |
| 30 | 6 | 4 | 60 | 16.87 | 7591 | −.020 | .297 |
| 20 | 6 | 4 | 70 | 16.78 | 7551 | −.013 | .143 |
| 10 | 6 | 4 | 80 | 16.69 | 7512 | −.006 | .032 |
| 0 | 6 | 4 | 90 | 16.61 | 7472 | .001 | .001 |
| 26 | 6 | 8 | 60 | 16.74 | 7531 | −.017 | .241 |
| 16 | 6 | 8 | 70 | 16.65 | 7492 | −.010 | .095 |
| 6 | 6 | 8 | 80 | 16.56 | 7452 | −.003 | .010 |
| 22 | 6 | 12 | 60 | 16.60 | 7472 | −.015 | .186 |
| 12 | 6 | 12 | 70 | 16.52 | 7433 | −.008 | .055 |
| 2 | 6 | 12 | 80 | 16.43 | 7393 | −.001 | .000 |
| 18 | 6 | 16 | 60 | 16.47 | 7413 | −.012 | .132 |
| 8 | 6 | 16 | 70 | 16.39 | 7373 | −.005 | .024 |
| 14 | 6 | 20 | 60 | 16.34 | 7354 | −.009 | .084 |
| 4 | 6 | 20 | 70 | 16.25 | 7314 | −.002 | .005 |
| 32 | 8 | 0 | 60 | 17.32 | 7794 | −.024 | .406 |
| 22 | 8 | 0 | 70 | 17.23 | 7755 | −.018 | .253 |
| 12 | 8 | 0 | 80 | 17.15 | 7715 | −.011 | .111 |
| 2 | 8 | 0 | 90 | 17.06 | 7676 | −.005 | .019 |
| 28 | 8 | 4 | 60 | 17.19 | 7735 | −.022 | .355 |
| 18 | 8 | 4 | 70 | 17.10 | 7696 | −.016 | .200 |
| 8 | 8 | 4 | 80 | 17.01 | 7656 | −.009 | .069 |
| 24 | 8 | 8 | 60 | 17.06 | 7676 | −.020 | .302 |
| 14 | 8 | 8 | 70 | 16.97 | 7636 | −.013 | .148 |
| 4 | 8 | 8 | 80 | 16.88 | 7597 | −.066 | .036 |
| 20 | 8 | 12 | 60 | 16.93 | 7616 | −.017 | .247 |
| 10 | 8 | 12 | 70 | 16.84 | 7577 | −.011 | .100 |
| 0 | 8 | 12 | 80 | 16.75 | 7538 | −.004 | .013 |
| 16 | 8 | 16 | 60 | 16.79 | 7557 | −.015 | .191 |
| 6 | 8 | 16 | 70 | 16.71 | 7518 | −.008 | .059 |
| 12 | 8 | 20 | 60 | 16.66 | 7498 | −.012 | .138 |
| 2 | 8 | 20 | 70 | 16.57 | 7458 | −.005 | .027 |
| 30 | 10 | 0 | 60 | 17.64 | 7939 | −.027 | .457 |
| 20 | 10 | 0 | 70 | 17.55 | 7899 | −.021 | .310 |
| 10 | 10 | 0 | 80 | 17.47 | 7860 | −.014 | .163 |
| 0 | 10 | 0 | 90 | 17.38 | 7820 | −.008 | .049 |
| 26 | 10 | 4 | 60 | 17.51 | 7879 | −.025 | .410 |
| 16 | 10 | 4 | 70 | 17.42 | 7840 | −.018 | .258 |
| 6 | 10 | 4 | 80 | 17.33 | 7800 | −.012 | .116 |
| 22 | 10 | 8 | 60 | 17.38 | 7820 | −.022 | .360 |
| 12 | 10 | 8 | 70 | 17.29 | 7781 | −.016 | .205 |
| 2 | 10 | 8 | 80 | 17.20 | 7741 | −.009 | .074 |
| 18 | 10 | 12 | 60 | 17.25 | 7761 | −.020 | .307 |
| 8 | 10 | 12 | 70 | 17.16 | 7721 | −.013 | .153 |
| 14 | 10 | 16 | 60 | 17.11 | 7701 | −.017 | .252 |
| 4 | 10 | 16 | 70 | 17.03 | 7662 | −.011 | .105 |
| 10 | 10 | 20 | 60 | 16.98 | 7642 | −.015 | .197 |
| 0 | 10 | 20 | 70 | 16.89 | 7603 | −.008 | .064 |
| 28 | 12 | 0 | 60 | 17.96 | 8083 | −.029 | .503 |
| 18 | 12 | 0 | 70 | 17.87 | 8043 | −.023 | .365 |
| 8 | 12 | 0 | 80 | 17.79 | 8004 | −.017 | .217 |
| 24 | 12 | 4 | 60 | 17.83 | 8024 | −.277 | .460 |
| 14 | 12 | 4 | 70 | 17.74 | 7984 | −.021 | .315 |
| 4 | 12 | 4 | 80 | 17.65 | 7945 | −.014 | .168 |
| 20 | 12 | 8 | 60 | 17.70 | 7964 | −.025 | .414 |
| 10 | 12 | 8 | 70 | 17.61 | 7925 | −.018 | .263 |
| 0 | 12 | 8 | 80 | 17.52 | 7885 | −.012 | .121 |
| 16 | 12 | 12 | 60 | 17.57 | 7905 | −.022 | .364 |
| 6 | 12 | 12 | 70 | 17.48 | 7866 | −.016 | .210 |
| 12 | 12 | 16 | 60 | 17.44 | 7846 | −.020 | .312 |

TABLE XXV-continued

Magnetization and Temperature Coefficient of $(NdGdDyHo)_2Fe_{14}B$ Alloys
W % $Gd_2Fe_{14}B$+ X % $Nd_2Fe_{14}B$+ Y % $Dy_2Fe_{14}B$+ Z % $HoFe_{14}B$

| COMPOSITION | | | | M(25C) | M(25C) | ALPHA | R |
|---|---|---|---|---|---|---|---|
| W | X | Y | Z | MB/FU | GAUSS | −50-200 | SQUARE |
| 2 | 12 | 16 | 70 | 17.35 | 7806 | −0.14 | .159 |
| 8 | 12 | 20 | 60 | 17.30 | 7786 | −.018 | .257 |

Table XXV shows alloy compositions of Nd with Gd, Dy and Ho if Nd varies from 8 to 12%, Dy from 0 to 15%, Gd from 0 to 8%, and Ho is within the range from 72 to 88%, the alloys exhibit the desired combination of properties.

What is claimed is:

1. A permanent magnet alloy consisting essentially of $R_2Fe_{14}B$, wherein R is a combination of rare earth elements consisting essentially of, in atomic percent, Nd 3 to 11 and balance Ho, said alloy exhibiting in combination $\alpha$ less than −0.01% per °C. over the temperature range of −50° C. to 250° C. and $M_s$ greater than 7500 Gauss at room temperature.

2. The alloy of claim 1 wherein R includes up to 10% Gd.

3. The alloy of claim 1 wherein R includes up to 15% Tb.

4. The alloy of claim 1 wherein R includes up to 10% Dy.

5. The alloy of claim 1 wherein R includes up to 18% Er.

6. The alloy of claim 1 wherein R includes up to 12% Tm.

7. A permanent magnet alloy consisting essentially of $R_2Fe_{14}B$, wherein R is a combination of rare earth elements consisitng essentially of, in atomic percent, Nd 3 to 11, at least one optional heavy rare earth element selected from the group consisting of Gd up to 10, Tb up to 15, Dy up to 16, Er up to 18 and Tm up to 12 and balance Ho, said alloy exhibiting in combination $\alpha$ less than −0.01% per °C. over the temperature range of −50° C. to 250° C. and $M_s$ greater than 7500 Gauss at room temperature.

8. The alloy of claim 1, or claim 2, or claim 3, or claim 4, or claim 5, or claim 6 or claim 7 wherein Ho is 75 to 92%.

9. A permanent magnet alloy consisting essentially of $R_2Fe_{14}B$, wherein R is a combination of rare elements consisting essentially of, in atomic percent, Nd 4 to 10, Tm 0 to 13 and Ho 83 to 96, said alloy exhibiting in combination alpha less than −0.01% per °C. over the temperature range of −50° C. to 250° C. and $M_s$ greater than 7500 Gauss at room temperature.

10. A permanent magnet alloy consisting essentially of $R_2Fe_{14}B$ wherein R is a combination of rare earth elements consisting essentially of, in atomic percent, Nd 5 to 11, Er 0 to 18, Ho 76 to 94, said alloy exhibiting in combination alpha less than −0.01% per °C. over the temperature range of −50° C. to 250 ° C. and $M_s$ greater than 7500 Gauss at room temperature.

11. A permanent magnet alloy consisting essentially of $R_2Fe_{14}B$ wherein R is a combination of rare earth elements consisting essentially of, in atomic percent, Nd 7 to 11, Tb 9 to 12 and Ho 78 to 90, said alloy exhibiting in combination alpha less than −0.01% per °C. over the temperature range of −50° C. to 250° C. and $M_s$ greater than 7500 Gauss at room temperature.

12. A permanent magnet alloy consisting essentially of $R_2Fe_{14}B$ wherein R is a combination of rare earth elements consisting essentially of, atomic percent Nd 7 to 11, Dy 0 to 15 and Ho 75 to 90, said alloy exhibiting in combinatio alpha less than −0.01% per °C. over the temperature range of −50° C. to 250° C. and $M_s$ greater than 7500 Gauss at room temperature.

13. A permanent magnet alloy consisting essentially of $R_2Fe_{14}B$ wherein R is a combination of a rare earth elements consisting essentially of, in atomic percent, Nd 7 to 11, Gd 0 to 10, and Ho 82 to 92, said alloy exhibiting in combination alpha less than −0.01% per °C. over the temperature range of −50° C. to 250° C. and $M_s$ greater than 7500 Gauss at room temperature.

14. A permanent magnet alloy consisting essentially of $R_2Fe_{14}B$ wherein R is a combination of rare earth elements consisting essentially of, in atomic percent, Nd 7 to 11, Gd 0 to 10, and Ho 82 to 92, said alloy exhibiting in combination alpha less than −0.01% per °C. over the temperature range of −50° C. to 250° C. and $M_s$ greater than 7500 Gauss at room temperature.

15. A permanent magnet alloy consisting essentially of $R_2Fe_{14}B$ wherein R is a combination of rare earth elements consisting essentially of, in atomic percent, Nd 6 to 10, Dy 0 to 8, Er 0 to 14, Ho 76 to 96, said alloy exhibiting in combination alpha less than −0.01% per °C. over the temperature range of −50° C. to 250° C. and $M_s$ greater than 7500 Gauss at room temperature.

16. A permanent magnet alloy consisting essentially of $R_2Fe_{14}B$ wherein R is a combination of rare earth elements consisting essentially of, in atomic percent, Nd 3 to 11, Tm 0 to 12, Er 0 to 18, and Ho 76 to 92, said alloy exhibiting in combination alpha less than −0.01% per °C. over the temperature range of −50° C. to 250° C. and $M_s$ greater than 7500 Gauss at room temperature.

17. A permanent magnet alloy consisting essentially of $R_2Fe_{14}B$ wherein R is a combination of rare earth elements consisting essentially of, in atomic percent, Nd 9 to 11, Dy 9 to 15, Tb 0 to 12, and Ho 75 to 88, said alloy exhibiting in combination alpha less than −0.01% per °C. over the temperature range of −50° C. to 250° C. and $M_s$ greater than 7500 Gauss at room temperature.

18. A permanent magnet alloy consisting essentially of $R_2Fe_{14}B$ wherein R is a combination of rare earth elements consisting essentially of, in atomic percent, Nd 8 to 12, Dy 0 to 15, Gd 0 to 8, and Ho 72 to 88, said alloy exhibiting in combination alpha less than −0.01% per °C. over the temperature range of −50° C. to 250° C. and $M_s$ greater than 7500 Gauss at room temperature.

* * * * *